US006268840B1

(12) United States Patent
Huang

(10) Patent No.: US 6,268,840 B1
(45) Date of Patent: Jul. 31, 2001

(54) UNIPOLAR WAVEFORM DRIVE METHOD AND APPARATUS FOR A BISTABLE LIQUID CRYSTAL DISPLAY

(75) Inventor: Xiao-Yang Huang, Stow, OH (US)

(73) Assignee: Kent Displays Incorporated, Kent, OH (US)

( * ) Notice: Subject to any disclaimer, the term of this patent is extended or adjusted under 35 U.S.C. 154(b) by 0 days.

(21) Appl. No.: 09/063,907

(22) Filed: Apr. 21, 1998

Related U.S. Application Data

(60) Provisional application No. 60/046,275, filed on May 12, 1997.

(51) Int. Cl.[7] ..... G09G 3/36

(52) U.S. Cl. ..... 345/94; 345/95; 345/210

(58) Field of Search ..... 345/87, 94, 95, 345/96, 97, 98, 99, 100, 210; 349/169, 179, 33, 34, 37

(56) References Cited

U.S. PATENT DOCUMENTS

| | | | |
|---|---|---|---|
| 4,317,115 | 2/1982 | Kawakami et al. | 340/784 |
| 4,419,664 | 12/1983 | Crossland et al. | 340/784 |
| 4,514,045 | 4/1985 | Huffman et al. | 350/351 |

(List continued on next page.)

FOREIGN PATENT DOCUMENTS

WO98/31002 7/1998 (WO) .

OTHER PUBLICATIONS

Article entitled Cholesteric Liquid Crystal Texture Change Displays, by J.J. Wysock, Gary A. Dir, J.H. Becker, J.E. Adams, W.E. Haas, L.B. Leader, B. Mechlowitz and E.D. Saeva, published in the Proceeding of S.I.D. vol. 13/2 Second Quarter, pp. 105–113 (1972).

Article entitled Front–Lit Flat Panel Display Polymer Stabilized Cholesteric Textures, J.W. Doane, D.K. Yang and Z. Yaniv, published in Japan Display, pp. 73–76 (1992).

Article entitled Cholesteric Liquid Crystal/Polymer Gel Dispersion : Reflective Display Application, by D.K. Yang and J.W. Doane, published in the SID Technical Paper Digest vol. XXIII May (1992), p. 759.

Article entitled Zero Field, Multistable Cholesteric Liquid Crytal Displays, authors, presented at IDRC Proceedings, Oct. 10–15, 1994, pp. 476–479.

*Primary Examiner*—Dennis-Doon Chow
(74) *Attorney, Agent, or Firm*—Watts, Hoffmann, Fisher & Heinke, Co., L.P.A.

(57) ABSTRACT

A flat-panel liquid crystal display having unipolar drive circuitry. The display includes a flat sheet of bistable chiral nematic liquid crystal material activated by a drive circuit that individually controls the display state of multiple picture elements at a refresh rate 1000 scan lines per second. The driver circuitry activates the liquid crystal domains into homeotropic states over a relatively long activation period and then, during a short (~1 msec.) selection period, either keeps the domains in a homeotropic state or initiate a transition to the transient twisted planar state. The drivers then activate the domains in an evolution phase to provide either focal conic or twisted planar end states across the two-dimensional array of picture elements. The drive circuitry includes a plurality of unipolar display drivers which generate substantially square wave, unipolar waveforms which are applied to row and column electro segments. The frequency and timing of the unipolar waveforms is controlled by the display driver circuitry to generate desired bi-polar voltages across picture elements or pixels of the display. A pipelining scheme wherein a number of pixel rows are addressed simultaneously during preparation, and evolution stages is used to reduce total updating time for the display.

28 Claims, 26 Drawing Sheets

PIXEL VOLTAGES APPLIED TO PIXEL TO CHANGE TO FOCAL CONICAL CONFIGURATION

U.S. PATENT DOCUMENTS

| | | | | |
|---|---|---|---|---|
| 4,626,074 | | 12/1986 | Crossland et al. | 350/345 |
| 4,636,788 | | 1/1987 | Hilbrink | 340/804 |
| 4,641,135 | | 2/1987 | Hilbrink | 340/784 |
| 4,668,049 | | 5/1987 | Canter et al. | 350/345 |
| 4,705,345 | | 11/1987 | Ayliffe et al. | 350/350 |
| 4,728,175 | | 3/1988 | Baron | 350/336 |
| 4,761,058 | | 8/1988 | Okubo et al. | 350/331 |
| 4,769,639 | | 9/1988 | Kawamura et al. | 340/784 |
| 4,790,631 | * | 12/1988 | Yamazaki | 349/143 |
| 4,864,538 | | 9/1989 | Buzak | 365/128 |
| 4,909,607 | | 3/1990 | Ross | 350/332 |
| 4,958,915 | | 9/1990 | Okada et al. | 350/345 |
| 5,036,317 | | 7/1991 | Buzak | 340/799 |
| 5,069,531 | * | 12/1991 | Yamazaki et al. | 349/127 |
| 5,132,823 | | 7/1992 | Kamath et al. | 359/70 |
| 5,168,378 | | 12/1992 | Black et al. | 359/38 |
| 5,168,380 | | 12/1992 | Fergason | 359/51 |
| 5,189,535 | | 2/1993 | Mochizuki et al. | 359/101 |
| 5,251,048 | | 10/1993 | Doane et al. | 359/70 |
| 5,252,954 | | 10/1993 | Nagata et al. | 345/95 |
| 5,260,699 | | 11/1993 | Lister et al. | 345/97 |
| 5,280,280 | | 1/1994 | Hotto | 345/94 |
| 5,285,214 | | 2/1994 | Bowry | 345/97 |
| 5,289,175 | | 2/1994 | Kawagishi | 345/97 |
| 5,289,300 | | 2/1994 | Yamazaki et al. | 359/31 |
| 5,293,261 | | 3/1994 | Shashidhar et al. | 359/103 |
| 5,315,101 | | 5/1994 | Hughes et al. | 250/208.1 |
| 5,384,067 | | 1/1995 | Doane et al. | 428/1 |
| 5,437,811 | | 8/1995 | Doane et al. | 252/99.01 |
| 5,453,863 | | 9/1995 | West et al. | 359/91 |
| 5,625,477 | | 4/1997 | Wu et al. | 349/35 |
| 5,644,330 | | 7/1997 | Catchpole et al. | 345/95 |
| 5,717,418 | | 2/1998 | Shapiro et al. | 345/87 |
| 5,724,060 | | 3/1998 | Graham et al. | 345/97 |
| 5,748,277 | | 5/1998 | Huang et al. | 345/95 |

* cited by examiner

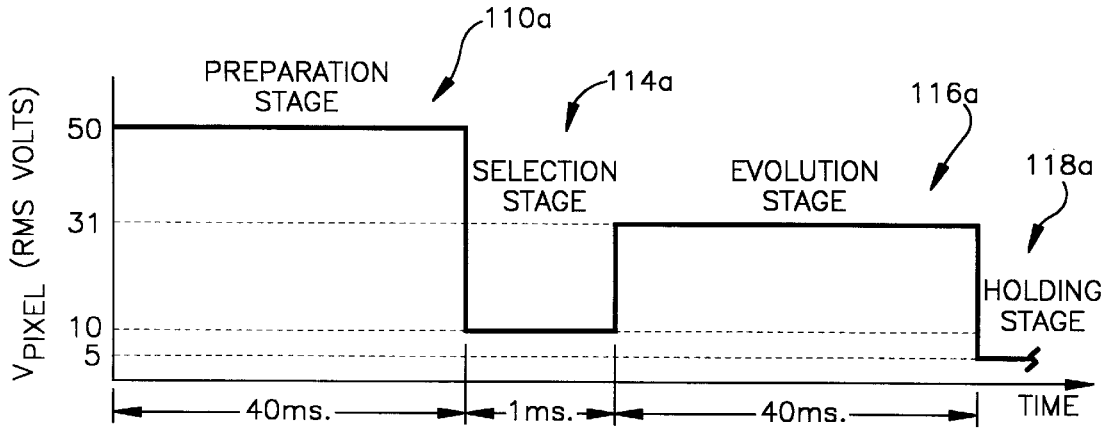
Fig.5A PIXEL VOLTAGES APPLIED TO PIXEL TO CHANGE TO FOCAL CONICAL CONFIGURATION
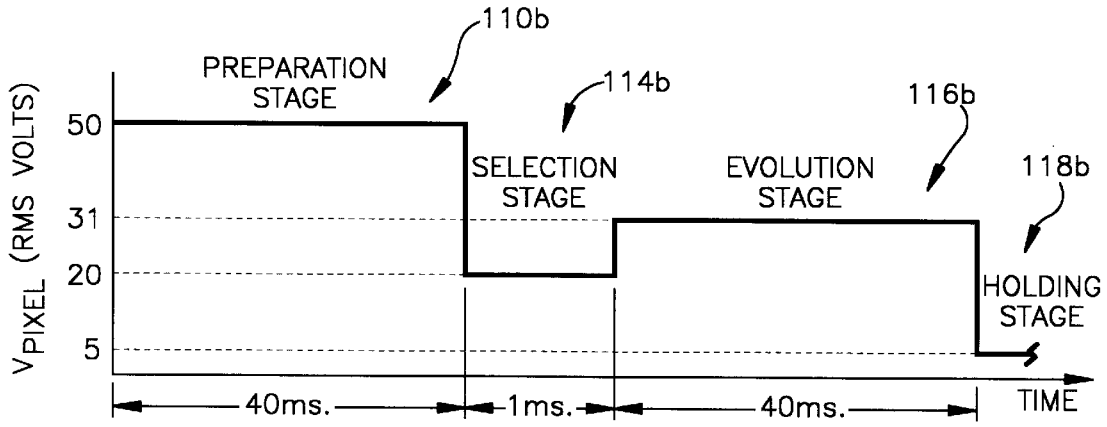
Fig.5B PIXEL VOLTAGES APPLIED TO PIXEL TO CHANGE TO TWISTED PLANAR CONFIGURATION

WAVEFORMS GENERATED BY DRIVER 500
OPERATING IN ROW DRIVER MODE

WAVEFORMS GENERATED BY DRIVER 500 OPERATING IN COLUMN DRIVER MODE

R/C*=1 (Row driver mode)

| Data | FRAME (FRI,FRO) | | | |
|---|---|---|---|---|
| (DI,DO) | (0,0) | (0,1) | (1,0) | (1,1) |
| (0,0)pre. | V1 | V1 | V8 | V8 |
| (0,1)sel. | V5 | V8 | V1 | V4 |
| (l,0)evl. | V3 | V3 | V6 | V6 |
| (1,1)hld. | V7 | V7 | V2 | V2 |

R/C*=0 (Column driver mode)

| Data | FRAME (FRI,FRO) | | | |
|---|---|---|---|---|
| (DI) | (0,0) | (0,1) | (1,0) | (1,1) |
| (1)on | V8 | V5 | V4 | V1 |
| (0)off | V5 | V8 | V1 | V4 |

TRUTH TABLE FOR OUTPUT LEVELS

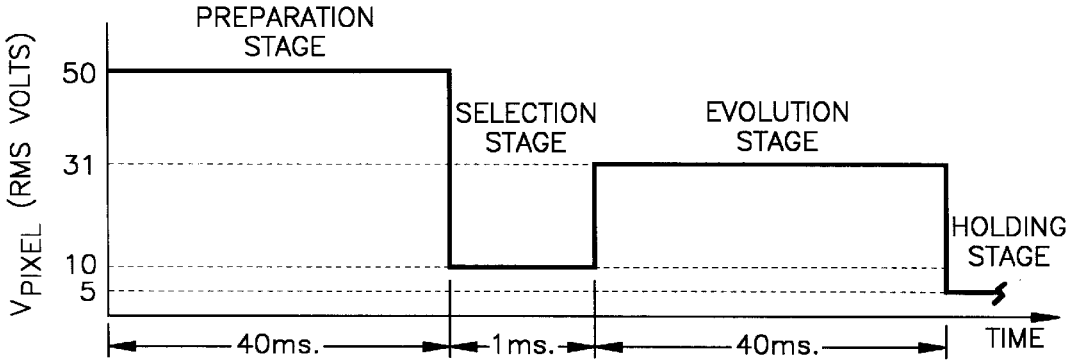
Fig.23 PIXEL VOLTAGES APPLIED TO PIXEL TO CHANGE TO FOCAL CONICAL CONFIGURATION
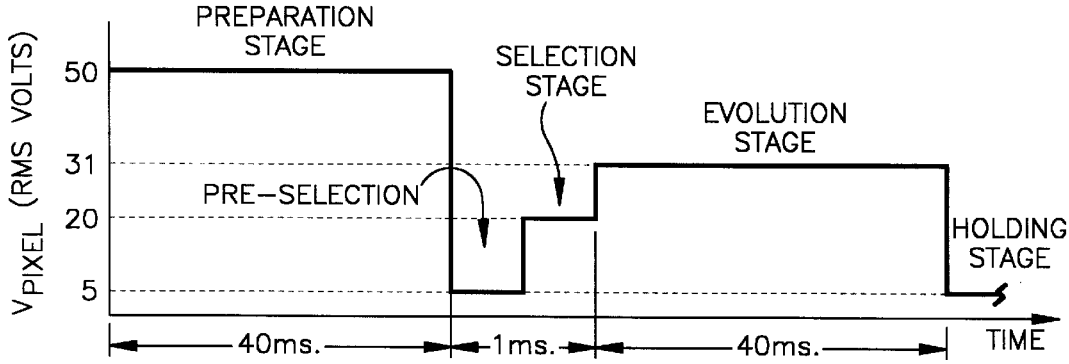
Fig.24 PIXEL VOLTAGES APPLIED TO PIXEL TO CHANGE TO TWISTED PLANAR CONFIGURATION
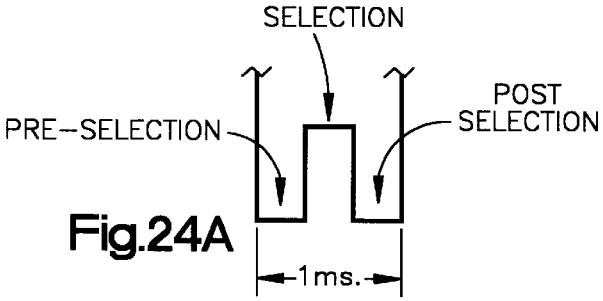
Fig.24A

UNIPOLAR WAVEFORM DRIVE METHOD AND APPARATUS FOR A BISTABLE LIQUID CRYSTAL DISPLAY

CROSS REFERENCE TO RELATED APPLICATION

The present application claims priority from pending U.S. provisional patent application Ser. No. 60/046,275 filed May 12, 1997 which is incorporated herein by reference.

This application was made in part with Government support under contract number N61331-94C-0041 awarded by the National Science Foundation. The Government has certain rights in this invention.

FIELD OF THE INVENTION

The present invention concerns a visual display utilizing a chiral nematic, also called cholesteric bistable liquid crystal material and an electronic drive system for activating the visual display using a pipelining scheme and unipolar waveforms to provide high-speed updating of the visual display.

BACKGROUND ART

Liquid crystals have been used to display information in flat-panel displays for many years, such as are commonly used in watch faces or half page size displays for lap-top computers and the like.

Liquid crystal displays made up of bistable chiral nematic materials do not require continuous updating or refreshing. When data or information changes on the display, the electronics update the display. If, however, the display information does not change, the display can be written once and remain in its information-conveying configuration for extended periods without display processor intervention. The ability to remain in a stable state for an extended period has resulted in use of chiral nematic liquid crystal displays for signs that can be slowly updated over relatively long periods of time. Since the display information does not change, the fact that it may take longer to write the initial information to the display is not important.

A number of prior art patents disclose techniques for updating liquid crystal display information. So-called liquid crystal display drivers or electronic circuits are known in the prior art and utilize various techniques for updating a liquid crystal display. U.S. Pat. No. 5,251,048 which issued Oct. 5, 1993 to Doane et al. concerns a method and apparatus for electronic switching of a reflective color display system. This patent discloses use of a liquid crystal light-modulating material that is confined between substrates. Elongated conductive paths supported on opposite sides of the substrates activate picture elements at controlled locations to set up a display screen. The disclosure of the '048 patent to Doane et al. is incorporated herein by reference.

A paper entitled "Storage Type Liquid Crystal Matrix Display" to Tani et al. (SID 79 Digest, p. 114–115) proposes a liquid crystal display driver system whose operation takes into account transitions between various states of a chiral nematic liquid crystal material. The paper describes a storage type liquid crystal display having the advantages of long storage time which makes refreshing or updating of the information on the display unnecessary. However, the Tani et al. drive scheme is limited in its resolution and information density conveying ability. His drive waveform and technology are limited in the number of lines that can be addressed to roughly 100 lines, far less than the 1000 lines required for page size viewer applications. Also, his demonstrated writing times of greater than 8 milliseconds (ms.) per line are insufficient for commercially acceptable page size viewers. On a flat-panel display or the like, 100 lines of information in a liquid crystal display is not acceptable for conveying text and 8 ms. per line is far too slow for many applications.

In the invention disclosed in U.S. application Ser. No. 08/390,068, filed Feb. 17, 1995 and entitled "Dynamic Drive Method and Apparatus For a Bistable Liquid Crystal Display," a method and display driver circuitry for speeding the rate of updating a 1,000 row cholesteric liquid crystal display was disclosed. Application Ser. No. 08/390,068 is incorporated herein in its entirety by reference. An updating time of approximately one second for a 1000 row cholesteric liquid crystal display was achieved. By simultaneously addressing multiple rows of the display with a pipelining scheme, the overall updating time for the display was kept at one second.

DISCLOSURE OF THE INVENTION

Prior art systems known to applicant use a bi-polar driver which requires high voltage which are implemented with relatively expensive electronic drive circuits. The present invention is directed to a unipolar drive scheme which is implemented with lower cost drive electronics.

An exemplary embodiment of the invention concerns a method of activating a bistable liquid crystal material disposed between a first set of electrodes and a second set of electrodes arranged on opposed sides of said liquid crystal material. Driver electronics is adapted to selectively apply an electric field through said liquid crystal material.

The driver electronics energizes the electrodes to establish a preparation voltage across said liquid crystal during a preparation stage. Thereafter the drive electronics energizes said electrodes to establish a selection voltage across said liquid crystal during a selection stage. During the selection state a display state for said liquid crystal is chosen. Thereafter the drive electronics energizes the electrodes to establish an evolution voltage across said liquid crystal during an evolution stage and the liquid crystal material subsequently exhibits its final display state in a holding stage.

During the multiple energization stages the drive electronics applies a first unipolar waveform to one electrode of the first set of electrodes and a second unipolar square waveform to one electrode to the second set of electrodes. The results of the application of signals to the electrodes produces a bipolar selection voltage waveform for choosing the final state of the liquid crystal material. Most preferably, the drive circuit is used to activate a whole array of electrodes which update the liquid crystal material between the array. One application of the invention is for use with a page viewer for viewing text on a hand held viewing screen. Other uses, objects, advantages and features of the invention will become understood from a review of the detailed description of the invention which is described in conjunction with the accompanying drawings.

BRIEF DESCRIPTION OF THE DRAWINGS

FIGS. 5A and 5B are schematic representation of the effective or rms voltages applied to a pixel to change its configuration to either the twisted planar or the focal conical configuration;

FIGS. 23, 24, and 24A illustrate an alternate drive scheme used to more quickly update a liquid crystal display.

DETAILED DESCRIPTION OF THE INVENTION

Figure 1:
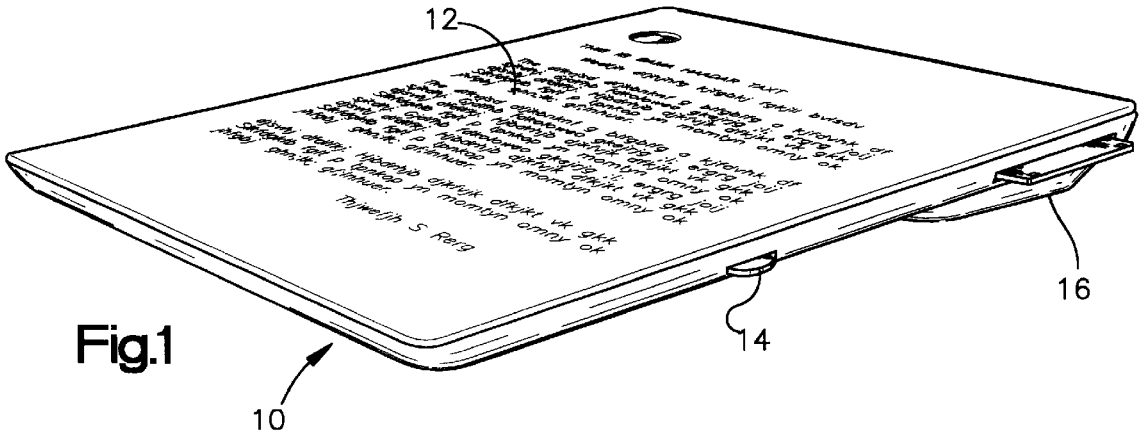
FIG. 1 is a perspective view showing a flat-panel liquid crystal display used for displaying images on a portable document viewer.

Turning now to the drawings, FIG. 1 shows a flat-panel liquid crystal display 10 for use with a document viewer 12. The particular viewer 12 shown in FIG. 1 is a portable electronic viewer for books, news or similar documents, which includes a page selection switch 14 that is integral with the unit and a memory card or floppy disk 16 which can carry the information to be viewed on the document viewer 12. Such a viewer 12 may conveniently include a hard disk drive, a floppy disk drive, and/or various other input/output devices.

The display 10 is most preferably capable of displaying images as well as text. For displaying images and text it is necessary to refresh or update the display 10 in about one second or less to limit user perception of the updating process. Resolution of the display 10 is quantified in terms of vertical and horizontal lines on the display screen. Present minimum resolution requirements for a page size document viewer is 1,000 lines, which must be capable of being addressed in less than about 1 second.

Although the invention is disclosed in the context of document viewer 12, the present invention has applicability to other displays for use with palm-held computers, pagers, computers for conveying specialized information, signs, electronic books and newspapers and the like as would be known to those of ordinary skill in the art in view of this disclosure. In addition, larger displays such as for highway signs and the like can incorporate the methods and apparatus of the invention.

The display 10 is constructed using a reflective bistable chiral nematic liquid crystal material whose display state can be controlled by application of a control voltage across the liquid crystal material. Suitable chiral nematic liquid crystal materials and cells, as well as their manner of preparation would be known to those of ordinary skill in the art in view of this disclosure. Preferred chiral nematic liquid crystal materials and cells are disclosed in, for example, co-pending application Ser. No. 08/057,662 filed May 4, 1993, and Ser. No. 07/969,093 filed Oct. 30, 1992, the disclosures of which are incorporated herein by reference. Depending upon the size and duration of the control voltage, a picture element (pixel) can be made to exhibit a light reflecting twisted planar texture, a homeotropic texture or a focal conic texture. Control over each picture element of the display is possible due to the ability of the chiral nematic liquid crystal material to be rapidly updated.

Figure 2:
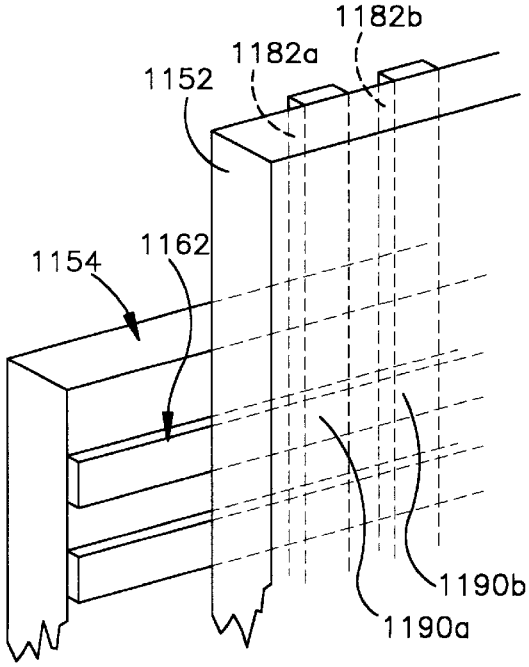
FIGS. 2 is a schematic depicting row and column energization electrodes for controlling a state of picture elements of the FIG. 1 flat-panel display.

FIG. 2 depicts the structure of a passive matrix type display for application of the inventive method. As can be seen in FIG. 2, plates 1152 and 1154 support transparent electrodes 1162 and 1182*a*, 1182*b* coated as lines onto the substrates. The pixels occur at the intersection of the conductive electrode 1162 with conductive electrodes 1182*a* and 1182*b*, respectively.

Figure 3A:
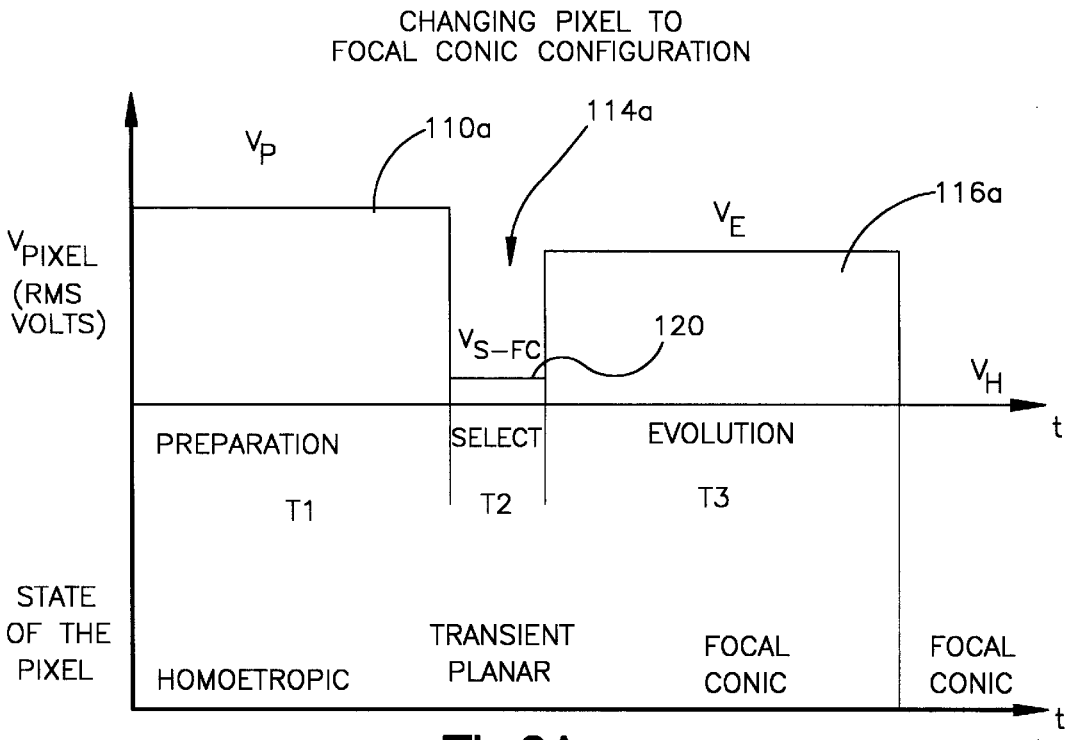
FIGS. 3A and 3B are voltage sequences that are coupled across liquid crystal material to achieve two different liquid crystal display states.
Figure 3B:
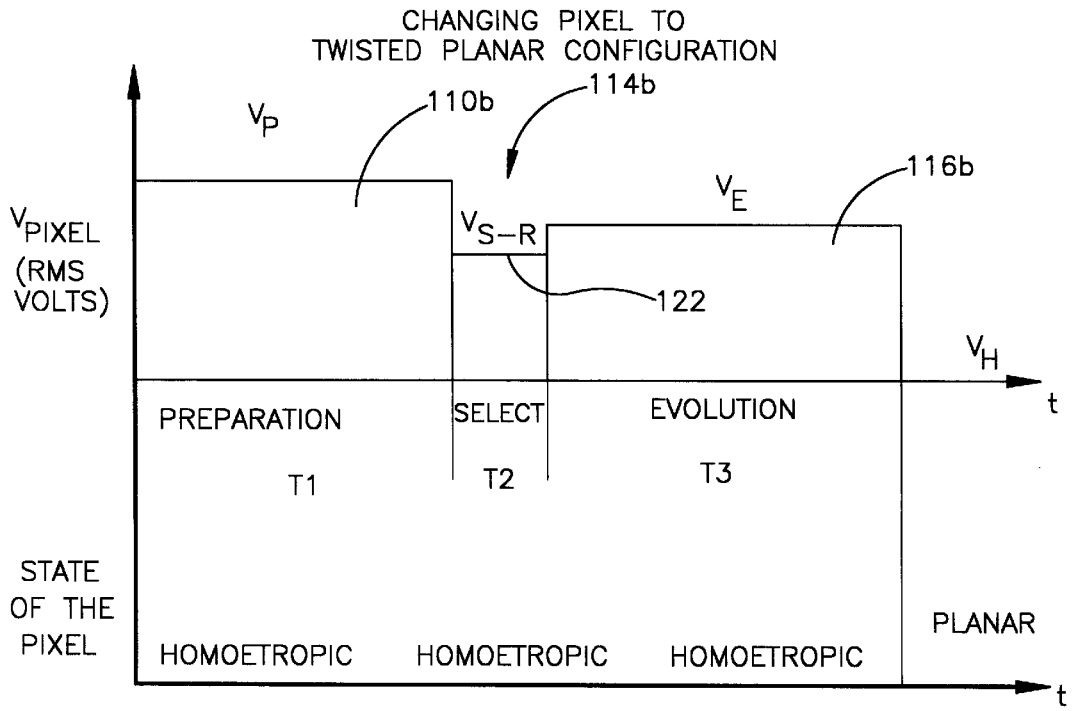

FIGS. 3A and 3B illustrate a manner in which the display state of a picture element is controlled. Chiral nematic liquid crystal material, as is known in the art, can be energized by application of a voltage to exhibit multiple optical states or textures. Three representative textures for the liquid crystal material are homeotropic, twisted planar, and focal conic. When in the homeotropic state, the liquid crystal material is transparent to normally incident light impinging upon the liquid crystal material. When in the focal conic state, the liquid crystal material weakly scatters the light, although if the path length is short enough the state can appear transparent, particularly when the back substrate is painted black. When in the twisted planar state, the liquid crystal material reflects the light. The final display state of picture elements of liquid crystal material that make up the display 10 is selected in accordance with the inventive method to be in either the focal conic or twisted planar state. The liquid crystal in the planar texture reflects light impinging upon the display, and the liquid crystal in the focal conic texture will appear transparent or weakly scattering to provide sufficient contrast with the planar texture. No back-lighting is required.

FIGS. 3A and 3B display effective or root means square (rms) voltages as a function of time applied across a picture element (pixel) to achieve either the focal conic (FIG. 3A) or the twisted planar (FIG. 3B) state. As seen in FIGS. 3A and 3B each of the control voltages applied to the liquid crystal material starts with a preparation phase 110*a*, 110*b* (in FIGS. 3A and 3B respectively of duration T1, during which the liquid crystal material is forced into its homeotropic state. The voltage during the preparation phase $V_P$, and the time duration of this phase T1 need to be sufficient to cause the complete transformation of the material to the homeotropic texture. Although there is no upper limit on the values that will drive the material to the homeotropic state, if they are too low then after the completion of the addressing cycle the device will not have as high a reflectivity in the reflecting state as is possible. However, in theory, once $V_P$ is high enough and T1 is long enough to drive the material completely into the homeotropic state, the preparation step is essentially satisfied and the final state of the pixel will not be dependent on the state of the pixel prior to the preparation phase. In practical application, the maximum value of $V_P$ is limited by the hardware. Moreover, an excessively long T1 conflicts with the objective of quickly updating the display. Thus, ideally the parameters for any given display should be optimized to employ a $V_P$ as low as possible to simplify the driver hardware and display design, and a T1 as short as possible to optimize driving speeds. Increasing the value of $V_P$ will in general shorten the value of T1.

In one embodiment, the preparation stage may be modified to allow less image retention from the initial states of the liquid crystal prior to entering the preparation phase, which degrades the final reflectance from the device. Typically, the values of $V_P$ and T1 will be higher than desirable in order to avoid this image retention effect. However, in this embodiment, the preparation stage can include a pre-aligning sequence adapted to more completely align the liquid crystal into the homeotropic texture prior to the selection phase. The pre-aligning sequence essentially comprises a first voltage pulse of a magnitude and duration sufficiently high to homeotropically align the liquid crystal as in the normal case of the preparation phase. However, the voltage is then reduced or removed for a short period of time, about 0.5 to 5 ms. to permit the liquid crystal to transform to the transient planar state, from which the liquid crystal can be more easily and completely switched into the homeotropic state with a high voltage $V_P$ for the remainder of the preparation phase. By more completely switching the material into the homeotropic texture during the preparation phase in accordance with this embodiment, any variation in the quality of the final optical state of a pixel caused by image retention of different initial states prior to the preparation phase is essentially eliminated. This also improves the contrast ratio. If desired, the pre-aligning sequence can be repeated several times during the preparation phase.

After an appropriate time period T1 which, in a preferred embodiment in the invention is approximately 40 milliseconds, the method enters the so called selection phase, wherein the liquid crystal material is activated with a selection voltage $V_S$ for selecting between the focal conic and twisted planar final state. An important aspect of the invention is that this so-called selection phase 114*a*, 114*b* (FIGS. 3*a* and 3*b*) only a short period T2 (about one or two milliseconds), much less than the preparation phase 110*a*, 110*b*. In application of the addressing sequence of the invention, the selection voltage may be applied to one line at a time, progressing down the rows in pipeline fashion.

Figure 3C:
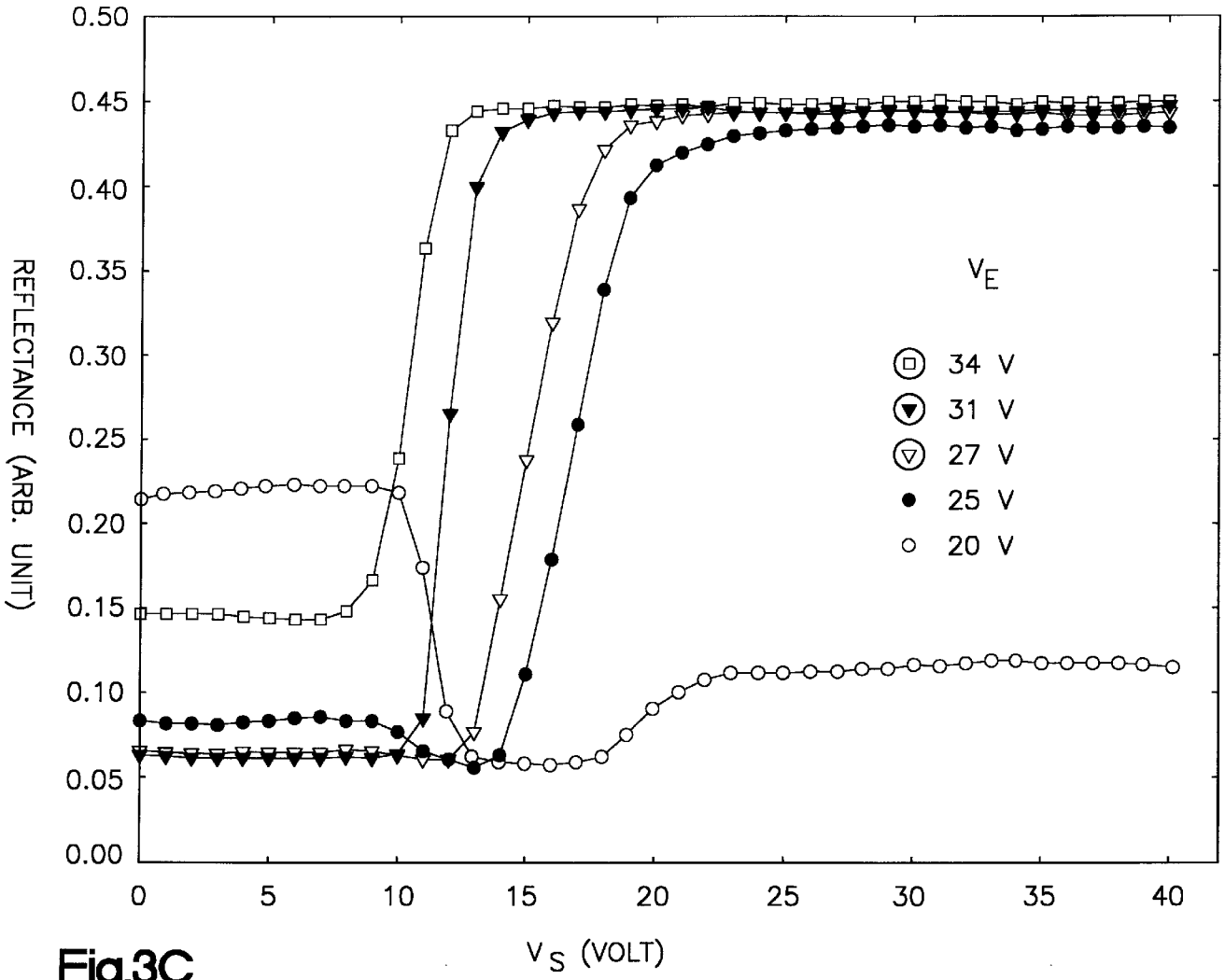
FIG. 3C is a plot showing the effect of varying evolution phase voltages on a final state of a liquid crystal material with respect to varying selection phase voltages.
Figure 14:
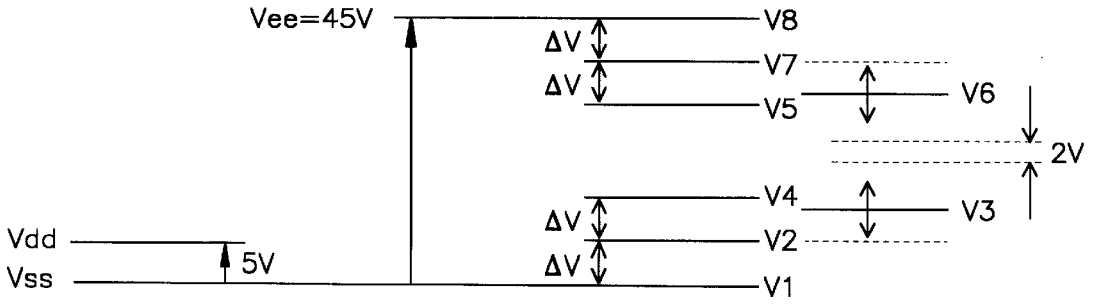
FIG. 14 is a schematic depiction of the relative sizes of 8 different voltage levels output from the outputs of the FIG. 13 integrated circuit.
Figure 15:
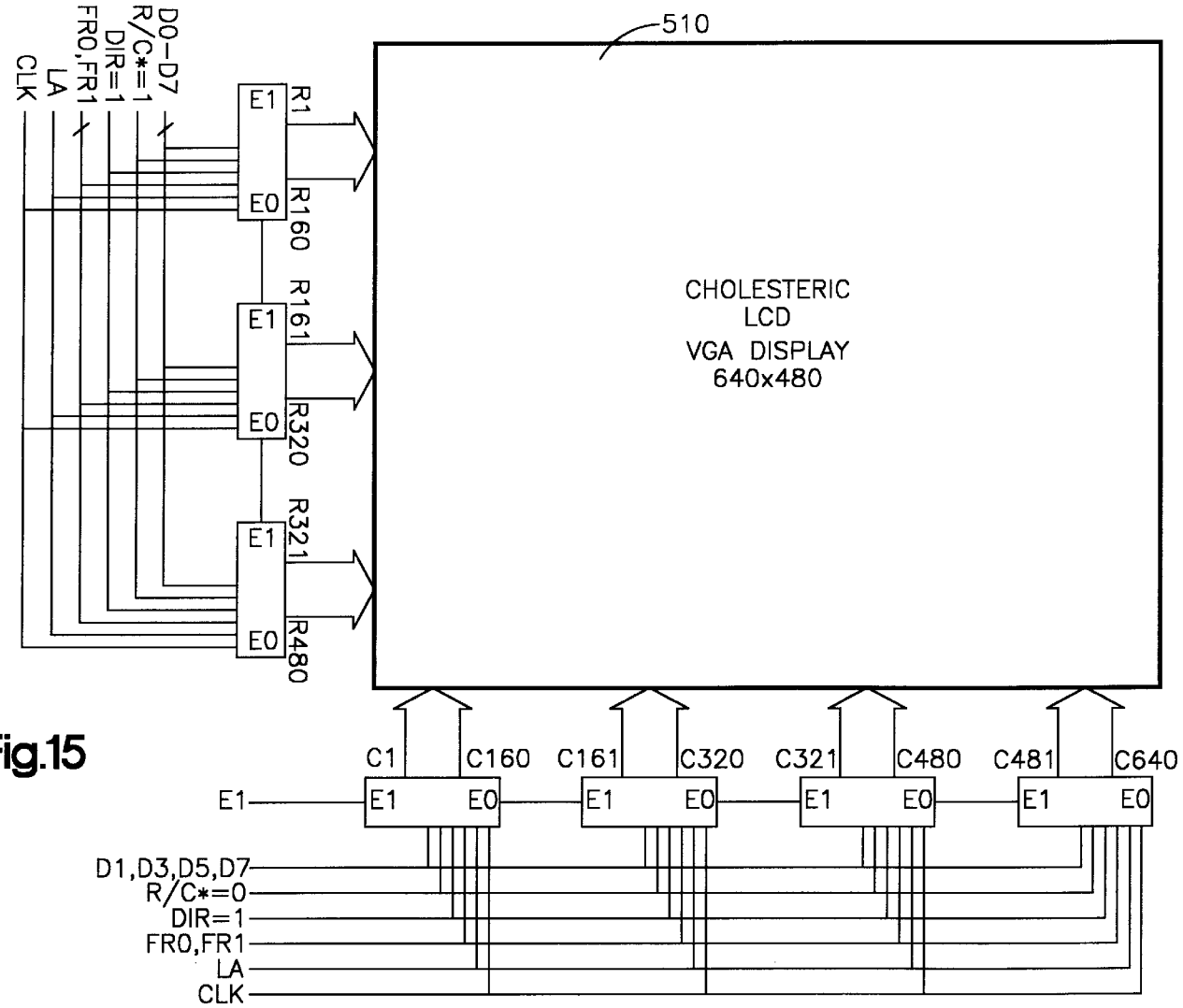
FIG. 15 is a schematic representation of a number of integrated circuits coupled to a liquid crystal display having a two dimension array of picture elements.
Figure 16:
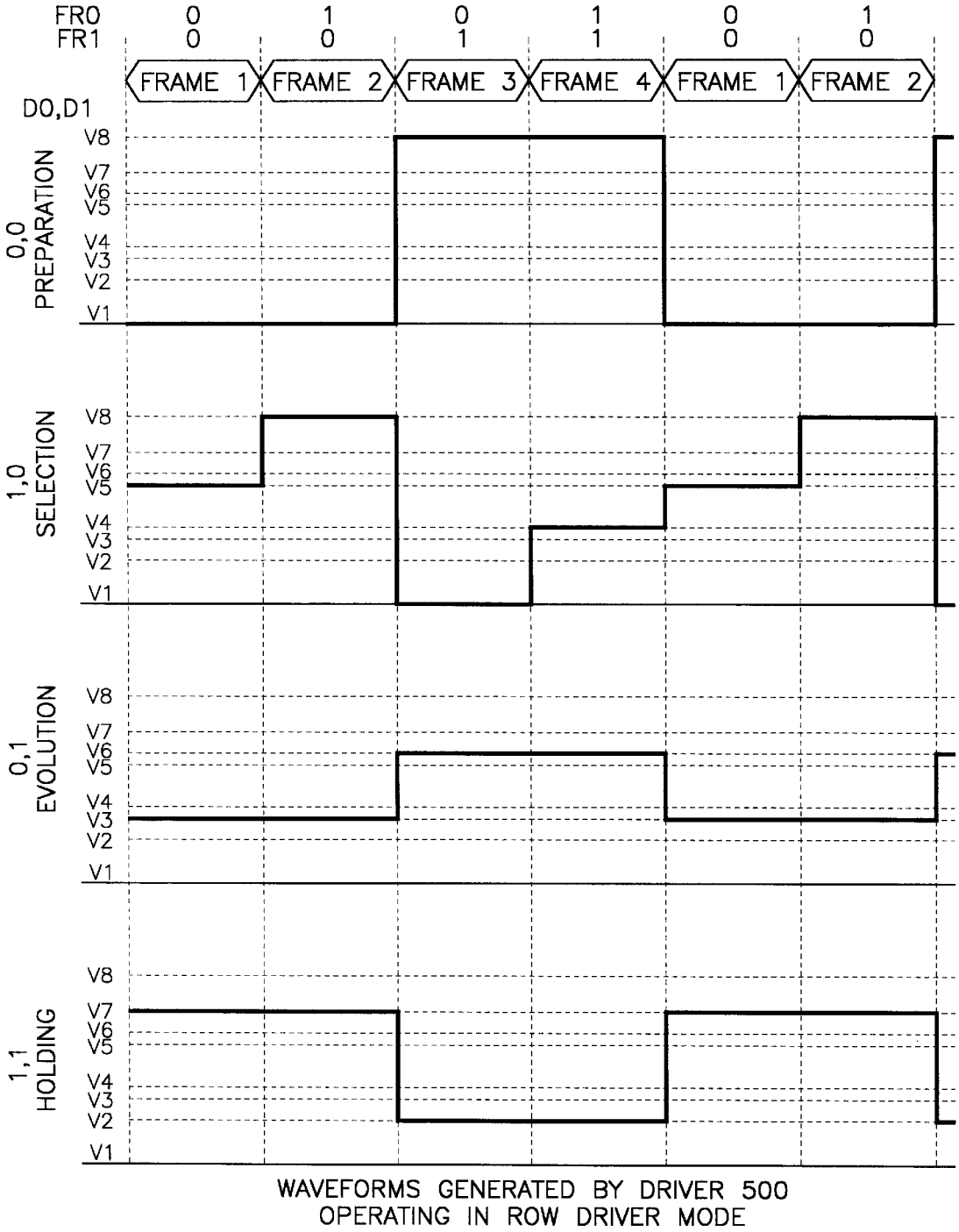
FIGS. 16 and 17 are schematic waveforms of a row and a column driver circuit outputs during four different energization phases wherein a selection voltage is dictated by two different waveforms from a column driver circuit.

Without wanting to be bound by theory, it is also contemplated that several lines may be selected simultaneously, with the plurality of selected rows being moved down the display in pipe line fashion. The ability to select more than one line at a time is in theory made possible due to the steepness of the select pulse (x axis) vs. final intensity curve as shown, for example, in FIG. 3C for the case of $V_E$ equal to 31 volts. As can be seen in FIG. 3C, 14 volts would be a sufficient selection voltage to drive the pixel to the reflective state (at $V_E$=31V), and 11 volts would be sufficiently low to drive the pixel to the focal conic state. By applying the well known Alt and Pleshko waveforms to the lines being selected, the number of lines that can be simultaneously selected is dependent on the ratio of the selection voltage necessary to drive the pixel to the reflective state ($V_{S\text{-}R}$), and the selection voltage necessary to drive the pixel to the focal conic state ($V_{S\text{-}FC}$) according to the relation: # lines=$[((V_{S\text{-}R}/V_{S\text{-}FC})^2+1)/((V_{S\text{-}R}/V_{S\text{-}FC})^2-1)]^2$. For the values of $V_{S\text{-}R}$ equal to 14 volts and $V_{S\text{-}FC}$ equal to 11 volts, this would indicate that about 18 lines could be selected at one time for the material and cell used to produce FIG. 3C.

During an evolution phase 116*a*, 116*b*, the liquid crystal material 50 is energized for a period T3 at an evolution voltage $V_E$ ($V_E$=31 volts rms) less than the preparation voltage, but greater than the selection voltage. In the evolution phase 116, the liquid crystal material is either maintained in a homeotropic configuration or evolves into a focal conic state. When the evolution voltage $V_E$ of FIGS. 3A and 3B is removed, the liquid crystal material 50 enters a focal conic (FIG. 3A) or twisted planar (FIG. 3B), final state depending upon the voltage chosen during the selection phase 114*a*, 114*b*. As seen by comparing the FIGS. 3A and 3B waveforms, the only difference in voltage occurs during the selection phase 114*a*, 114*b* during which $V_S$ either has a relatively low voltage $V_{S\text{-}FC}$ 120 (10 volts rms) (FIG. 5A) or a higher voltage $V_{S\text{-}R}$ 122 (20 volts rms) (FIG. 5B) which determines the final state of the picture element to be focal conic or light reflecting twisted planar, respectively.

While the selection voltage determines the final state of a pixel, it is noted that the evolution voltage can effect the appearance of the pixel. FIG. 3C shows the effect of the choice of $V_E$ on a graph of selection voltage versus final device reflectance. It can be seen that for $V_E$ greater than 34 volts a selection voltage $V_S$ of less than 11 volts does not result in a state of lower reflection, and that for $V_E$ less than 25 volts the same problem occurs, and the reflection resulting from $V_S$ greater than 14 volts is reduced from its maximum value. Thus, with this device it has been found that for proper operation of the addressing scheme according to this preferred embodiment, $V_E$ must be between 25 and 34 volts, with 31 being a preferred value. It is also notable that by increasing T3, the duration of the evolution phase, one can improve the contrast ratios between the twisted planar and focal conic states. As shown in FIGS. 5A and 5B, the duration of the evolution stage is approximately 30 ms. However, this also has the effect of slowing the drive speeds. Conversely, while increasing the value of $V_E$ is conducive to faster speeds, it reduces the contrast ratio. Of course, the specific optimum voltages will vary depending upon specific materials used and construction of the cell, but it would be within the ordinary skill in the art to optimize such parameters in view of the instant disclosure.

Unipolar Drive Scheme Implementation

The waveforms depicted in FIGS. 3A and 3B are root mean square voltage (rms) representations. The actual waveforms for the first preferred drive scheme of the present invention are shown in FIGS. 6A–6D. In each of the preparation (FIG. 6A), selection (FIG. 6B), evolution (FIG. 6C) and holding stages (FIG. 6D), unipolar waveforms (labeled Vcolumn and Vrow) are applied to row and column electrodes, for any given pixel, pi,j formed by the intersection of column electrode segment Cj and row electrode segment Ri (see FIG. 11 which schematically illustrates a 320 row by 320 column display), the row and column waveforms (Vcolumn and Vrow) applied to column electrode segment Cl and row electrode segment Ri algebraically combine to generate a bipolar waveform which oscillates above and below ground (zero volts) according to the equation:

$$Vpixel(pi,j)=Vcolumn(Cj)-Vrow(Ri).$$

The RMS voltages across the liquid crystal material 50 are about 50 volts during the preparation phase 110*a*, 110*b* (FIGS. 5A and 5B) for a duration of 40 ms. and 31 volts during the evolution phase 116*a*, 116*b* (FIGS. 5A and 5B) for a duration of 40 ms. If a pixel, pij, is to be changed to the focal conical configuration, 10 volts rms is applied during the selection stage 114*a* for a duration of 2 ms. and, if the pixel is to be changed to the twisted planar configuration, 20 volts rms is applied during the selection stage 114*b* for a duration of 2 ms. After the evolution phase 116*a*, 116*b*, a 5 volt rms signal is applied during the holding stage 118*a*, 118*b* which remains until the row electrode segment Ri of the pixel once again enters the preparation stage that is, the pipelining scheme has updated or cycled through all the rows and has returned again to row Ri.

Figure 4A:
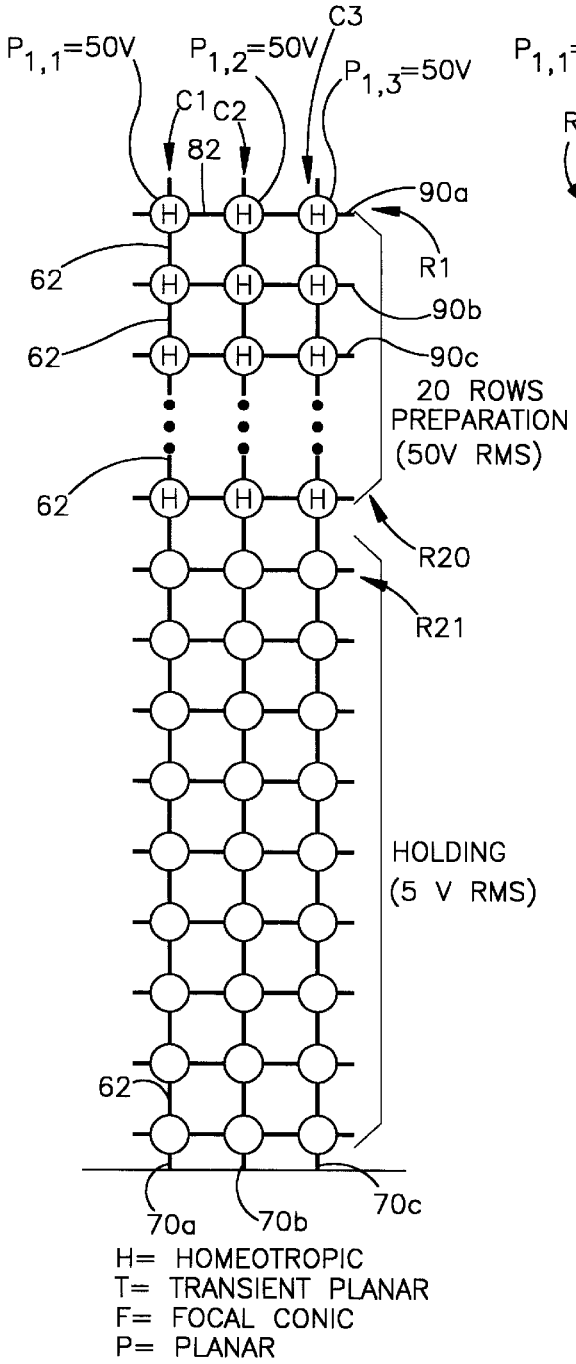
FIGS. 4A–4F are schematics showing a partial electrode array which is energized by display driver circuitry for controlling the display states of picture elements defined by liquid crystal material sandwiched between the electrodes.
Figure 7:
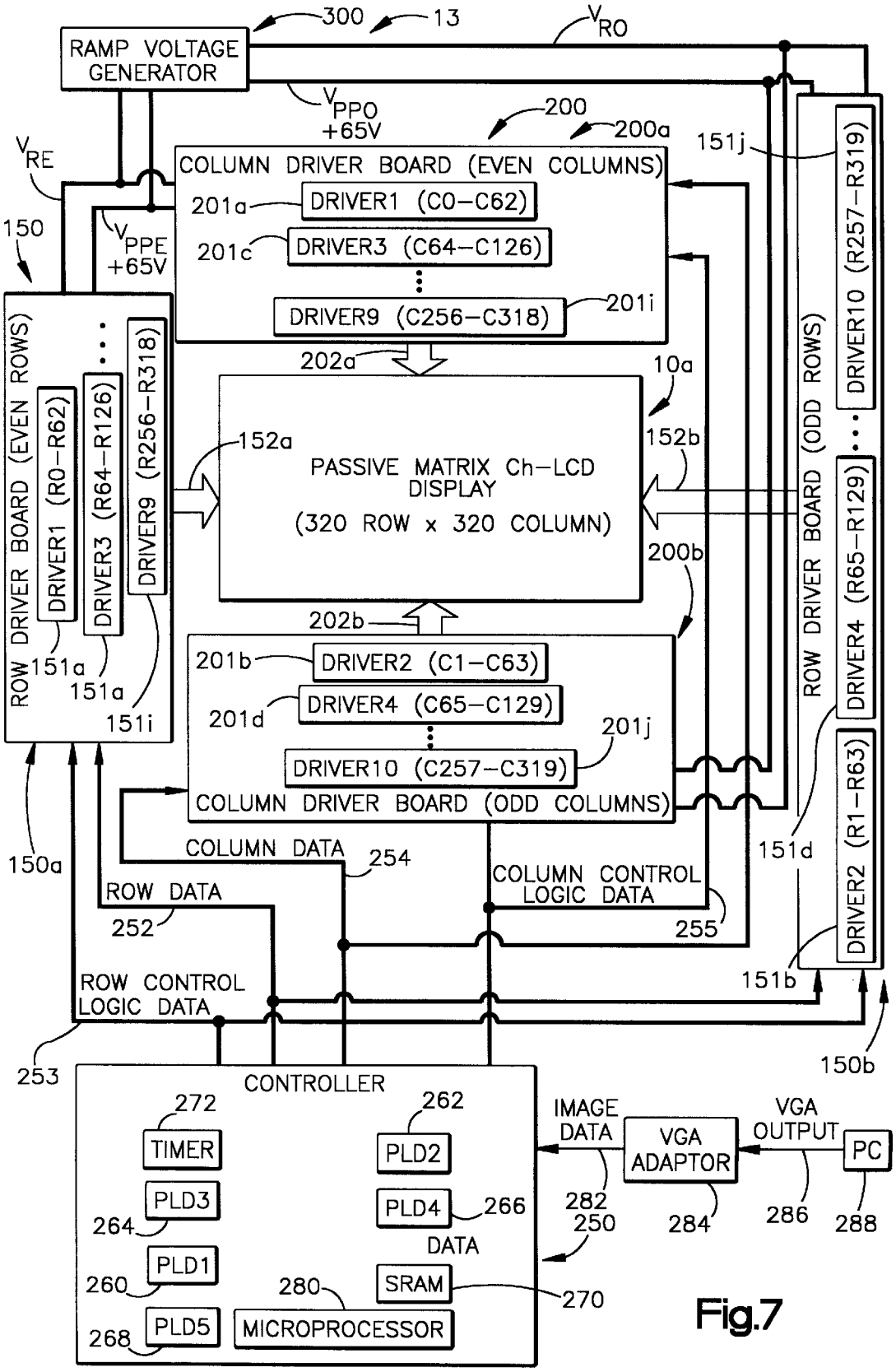
FIG. 7 is a block diagram of display driver circuitry for providing drive signals to activate a 320 row by 320 column passive matrix cholesteric liquid crystal display.

FIGS. 4A–4F illustrate a manner in which these voltages are applied by the FIG. 7 driver circuitry 13 which is electrically coupled at edge inputs or connections to the row and column electrode segments. Turning to FIG. 4A, this Figure depicts a plan view of the electrodes with the intervening structure of the containment plates and liquid crystal material. The column electrode 60*a* in the upper left-hand corner of FIG. 4A overlies the row electrode 80*a* defining a picture element or pixel p1,1 and, in a similar manner, the two electrodes 60*b*, 60*c* overlie the electrodes 80*b*, 80*c* defining pixels p1,2 and p1,3 respectively. The instanteous state of the representative pixels are denoted as follows:

"H"—a pixel is in the homeotropic state;
"T"—a pixel is in the transient planar state;
"P"—a pixel is in the twisted planar state; and
"F"—a pixel is in the focal conic state.

In FIG. 4A, each of 20 rows labeled R1–R20 simultaneously receives a 50 volt rms signal during the preparation phase or stage 110*a*, 110*b*. A first row R1 consisting of pixels p1,1, p1,2, p1,3 are about to complete its preparation phase 110 and pixels in row R20 are just beginning their preparation phase. The pixels in the preparation phase are converted to the homeotropic state. The rows of pixels identified by row R21 are in the holding stage and, therefore, are subjected to a holding voltage of 5 volts rms. In the holding stage the pixels maintain their respective current states, that is, a pixel in the twisted planar state is maintained in the twisted planar state and a pixel in the focal conic state is maintained in the focal conic state.

Figure 4B:
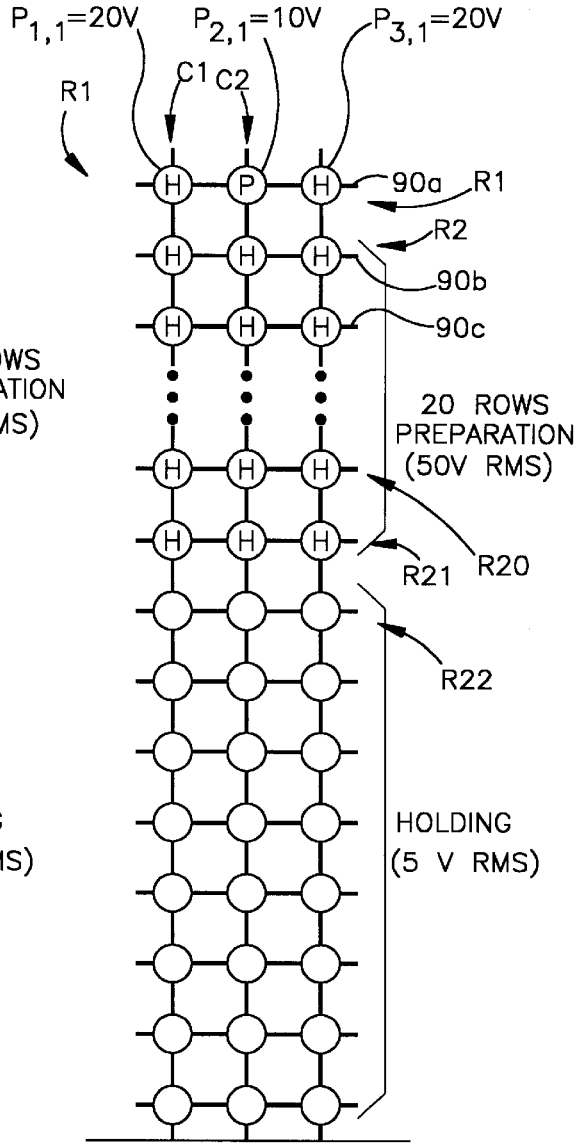
Figure 6A:
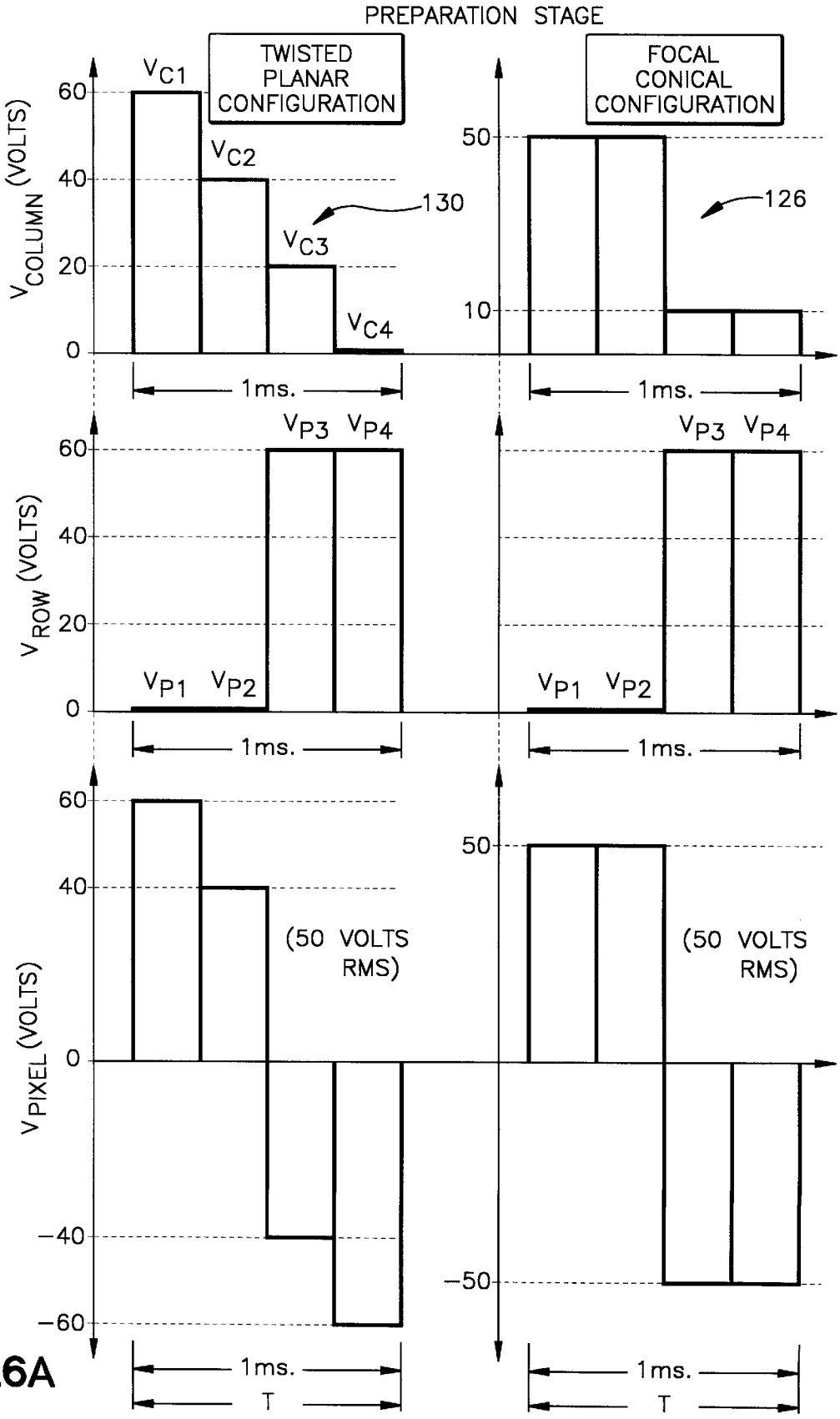
FIGS. 6A, 6B, 6C, 6D are a series of waveforms applied to row electrode segments and column electrode segments to change display configuration to display pixels.
Figure 6B:
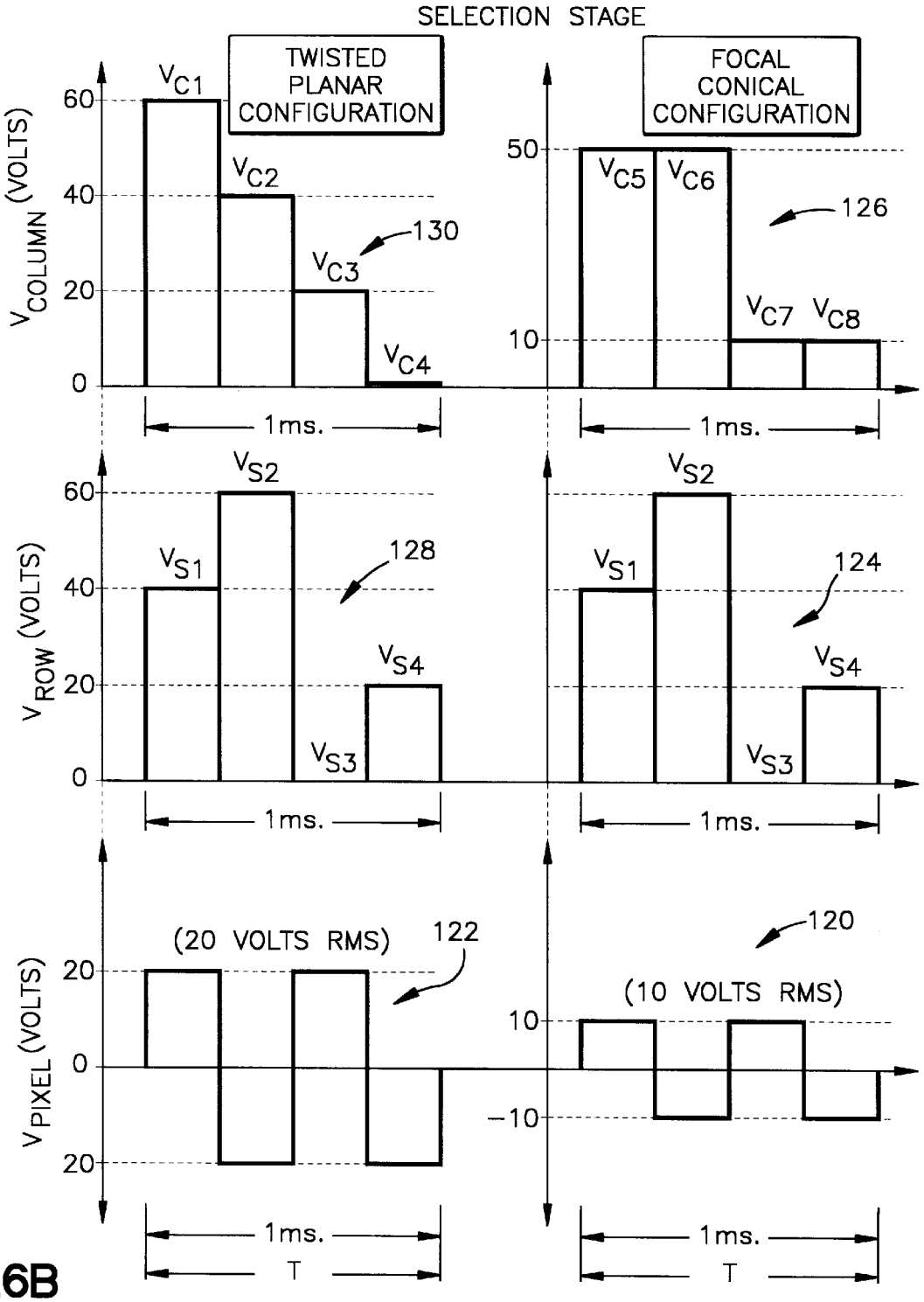

Turning to FIG. 4B, the display driver circuitry 13 has shifted the 50-volt rms signal one row downward as seen in FIG. 4B so that 19 of the 20 rows (R2–R20) depicted in FIG. 4A remain in the preparation phase and new row R21 is also now in the preparation stage (hence the term "pipeline" drive scheme). Assuming that the pixel p1,1 is to be converted to the twisted planar configuration, the pixel p1,2 is to be converted to the planar focal conic configuration, and the pixel p1,3 is to be converted to the twisted planar configuration, the pixel p1,2 is subjected to a 10 volt rms signal in the selection stage as shown in FIG. 6B at the resultant pixel voltage waveform labeled 120, the pixel p1,1 is subjected to a 20 volt rms signal in the selection stage as shown in FIG. 6B at the resultant pixel voltage waveform labeled 122, and the pixel p1,3 is subjected to a 20 volt rms signal in the selection stage shown at the resultant pixel voltage waveform labeled 122 in FIG. 6B. The duration of the signal during the selection stage is 2 ms. For the pixel p1,2, the specific unipolar waveforms for the row electrode 80*a* and column electrode 60*a* which combine algebraically to generate the resultant bipolar voltage waveform, Vpixel, across pixel p1,2 are shown at 124, 126 in FIG. 6B and are as follows:

For pixel p1,2 to be changed to focal conical configuration—selection stage voltage waveforms:

| Time period | Row voltage applied | Column voltage applied |
|---|---|---|
| 0–0.24 ms. | 40 volts | 50 volts |
| 0.25–0.49 ms. | 60 volts | 50 volts |
| 0.5–0.74 ms. | 0 volts | 10 volts |
| 0.75–0.99 ms. | 20 volts | 10 volts |
| 1.00–1.24 ms. | 40 volts | 50 volts |
| 1.25–1.49 ms. | 60 volts | 50 volts |
| 1.5–1.74 ms. | 0 volts | 10 volts |
| 1.75–1.99 ms. | 20 volts | 10 volts |

Figure 4C:
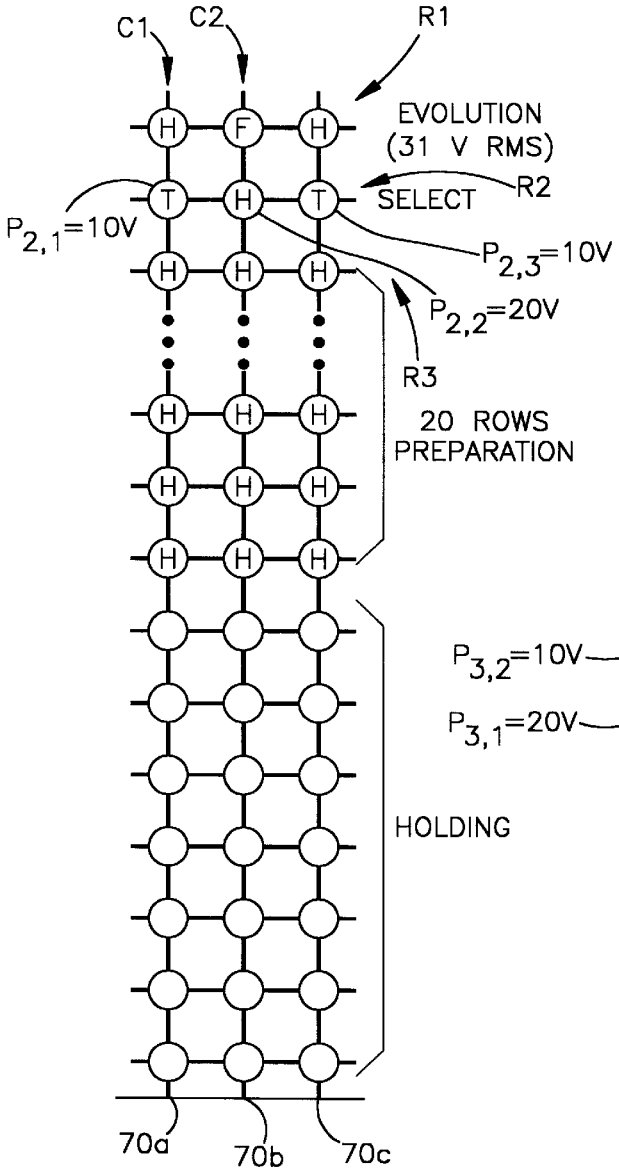

At the end of the selection phase, the pixel p1,2 is converted to the transient planar state (as represented by the letter "T" in FIG. 4B). As can be seen in FIG. 4C, at the start of the evolution phase, the state of the pixel p1,2 changes to the focal conic configuration (as represented by the letter "F" in FIG. 4C).

For the pixels p1,1 and p1,3, the specific unipolar waveforms for the row electrode 80*b* and column electrode 60*b* which combine algebraically to generate the resultant bipolar waveform, Vpixel, across pixels p1,1 and p1,3 are shown at 128, 130 in FIG. 6B.

For pixels p1,1 and p1,3 to be changed to twisted planar configuration selection stage voltage waveforms are as follows:

| Time period | Row voltage applied | Column voltage applied |
|---|---|---|
| 0–0.24 ms. | 40 volts | 60 volts |
| 0.25–0.49 ms. | 60 volts | 40 volts |
| 0.5–0.74 ms. | 0 volts | 20 volts |
| 0.75–0.99 ms. | 20 volts | 0 volts |
| 1.00–1.24 ms. | 40 volts | 60 volts |
| 1.25–1.49 ms. | 60 volts | 40 volts |
| 1.5–1.74 ms. | 0 volts | 20 volts |
| 1.75–1.99 ms. | 20 volts | 0 volts |

Note that the row voltage values are the same for all the electrodes in the selected row, that is, the waveform shown in FIG. 6B at 124 is identical to the waveform shown at 128. This, of course, must be true since electrodes 80*a*, 80*b*, 80*c* are all part of the row electrode segment R1. Thus, the voltage applied to the row electrode 80*a* for 2 ms. during the selection stage is the same as the voltage applied to the row electrode 80*b* and is the same as the voltage applied to the row electrode 80*c*.

The column waveforms 126, 128 are different, however, and account for the differences in Vpixel between the pixels in row electrode segment R1 during the 2 ms. selection stage. That is, the pixel p1,2 is subjected to a Vpixel of 10 volts rms while the pixel p1,1 is subjected to a Vpixel of 20 volts rms because column electrode segment C1 is coupled to column waveform 130 while column electrode segment C2 is coupled to column waveform 126.

Figure 6C:
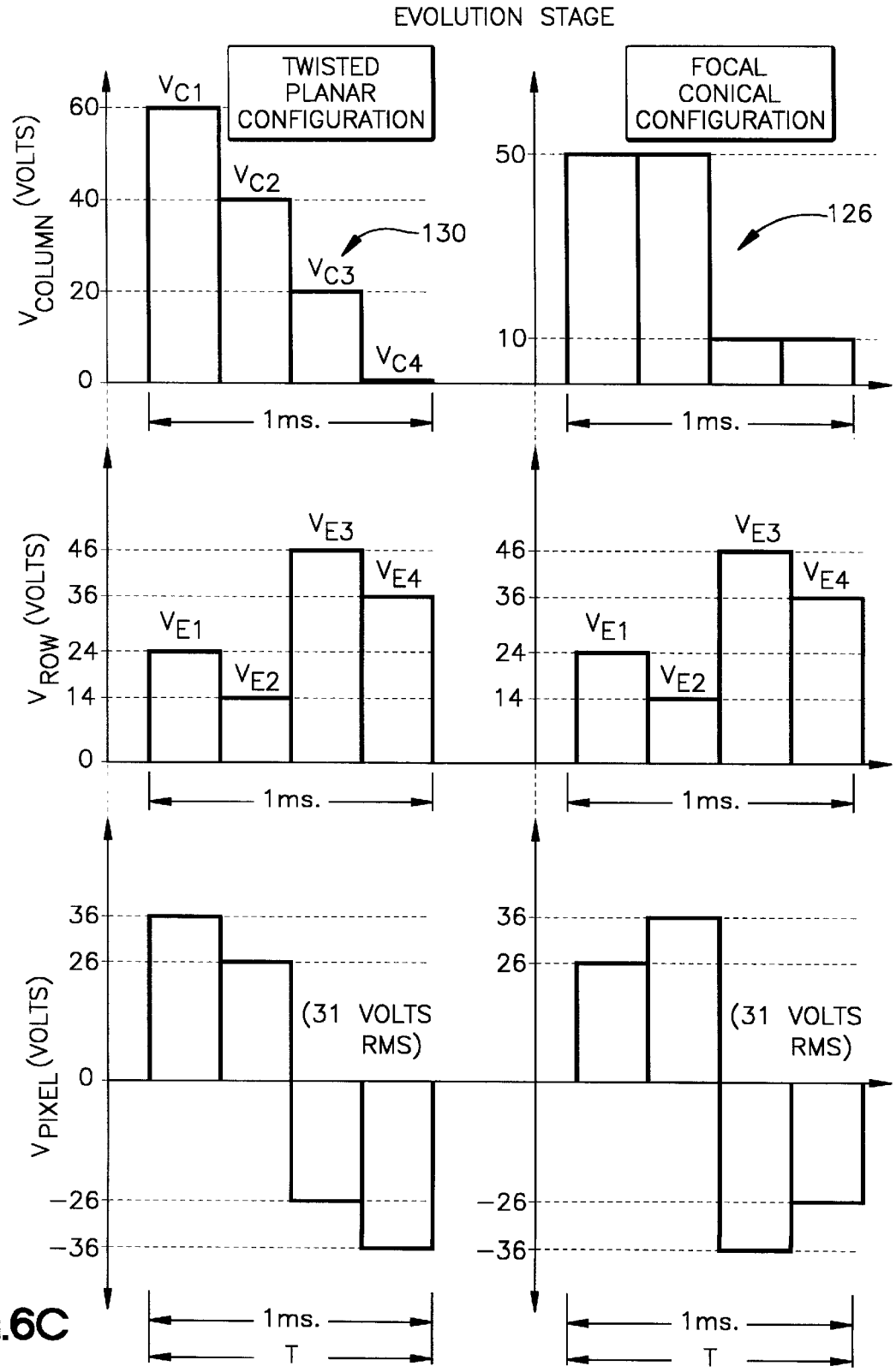
Figure 6D:
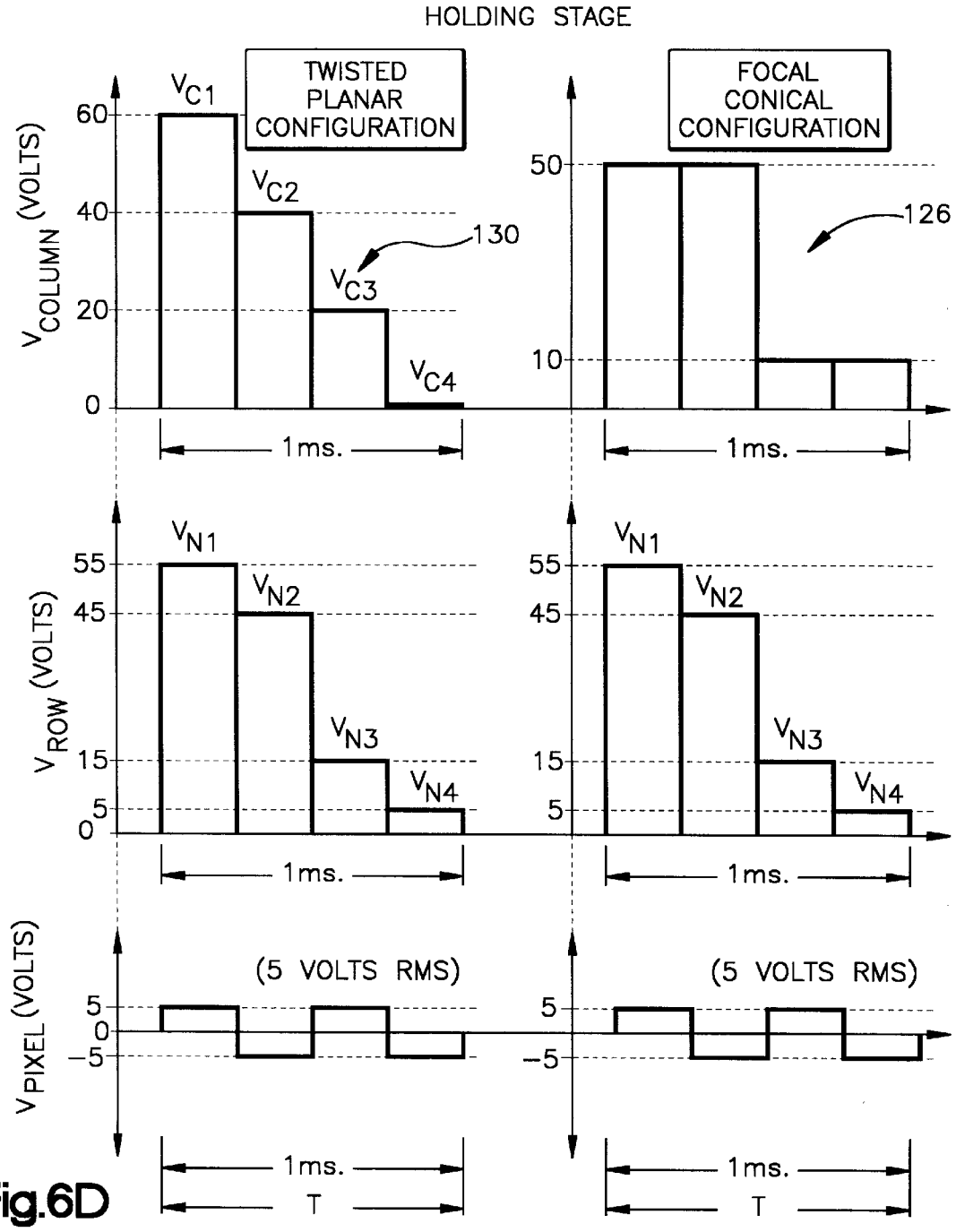

It is also true that all pixels corresponding to electrodes in a given column electrode segment such as C1 or C2 similarly receive the same voltage waveform. For example, all the electrodes which are part of column electrode segment C1 are subjected to the column waveform 130 for 2 ms. Since the pixel p1,1 in the currently selected row R1 is to be changed to the twisted planar configuration, while all the electrodes on column electrode segment C2 are subjected to the column waveform 126 for 2 ms. since the pixel p1,2 in the currently selected row R1 is to be changed to the focal conic configuration. Thus, the same column waveform 130, of course, is applied to every column electrode in column C1. Thus, as can be seen in FIG. 6A, the same column waveform 130 is applied to every column electrode of column electrode segment C1 in the preparation stage. And, as can be seen in FIG. 6C, the same waveform 130 is applied to every column electrode of column C1 in the evolution stage. Further, as can be seen in FIG. 6D, the same waveform 130 is applied to every column electrode of column C1 in the holding stage.

The same is also true for all the column electrodes of the column electrode segment C2. The electrodes in column C2 similarly receive the same voltage waveform for 2 ms. as applied to the column electrode corresponding to the selected row pixel p1,2. That is, since the pixel p1,1 is to be changed to the focal conic planar configuration, then the waveform shown at 126 in FIG. 6B is applied to the column electrode 60*b*. That same waveform 126, of course, is applied to every column electrode in column C2. Thus, as can be seen in FIG. 6A, the same column waveform 126 is applied as the column waveform to the column electrodes of column C2 in the preparation stage. And, as can be seen in FIG. 6C, the same waveform 126 is applied as the column waveform to the column electrodes of column C2 in the evolution stage. Further, as can be seen in FIG. 6D, the same waveform 130 is applied as the column waveform to the column electrodes of column C2 in the holding stage.

Further, it should be noted that the pixels p1,1 and p1,3 remain in the homeotropic configuration at the end of the selection stage (hence the letter "H" in the circle representing the pixel in FIG. 4B). By the end of the evolution stage, however, the pixels p1,1 and p1,3 will change to the twisted planar configuration as can be seen in FIG. 4E with the designations "P".

In FIG. 4C, the pixels of electrode row R2 are now selected. The row and column electrodes corresponding to pixel p2,2 receive the 20 volt rms selection stage voltage corresponding to the waveforms 128 (row electrode waveform), 130 (column electrode waveform), 122 (resultant pixel waveform, Vpixel) of FIG. 6B for a duration of 2 ms. (2 times T shown in FIG. 6B) to switch to the twisted planar configuration. The electrodes comprising pixels p2,1, p2,3 receive the 10 volt rms selection stage voltage corresponding to the waveforms 124 (column electrode waveform), 126 (column electrode waveform), 120 (resultant pixel waveform) in FIG. 6B for a duration of 2 ms. (2 times T shown in FIG. 6B) to maintain the homeotropic configuration which will evolve into the focal conical configuration by the end of the evolution stage.

Figure 4D:
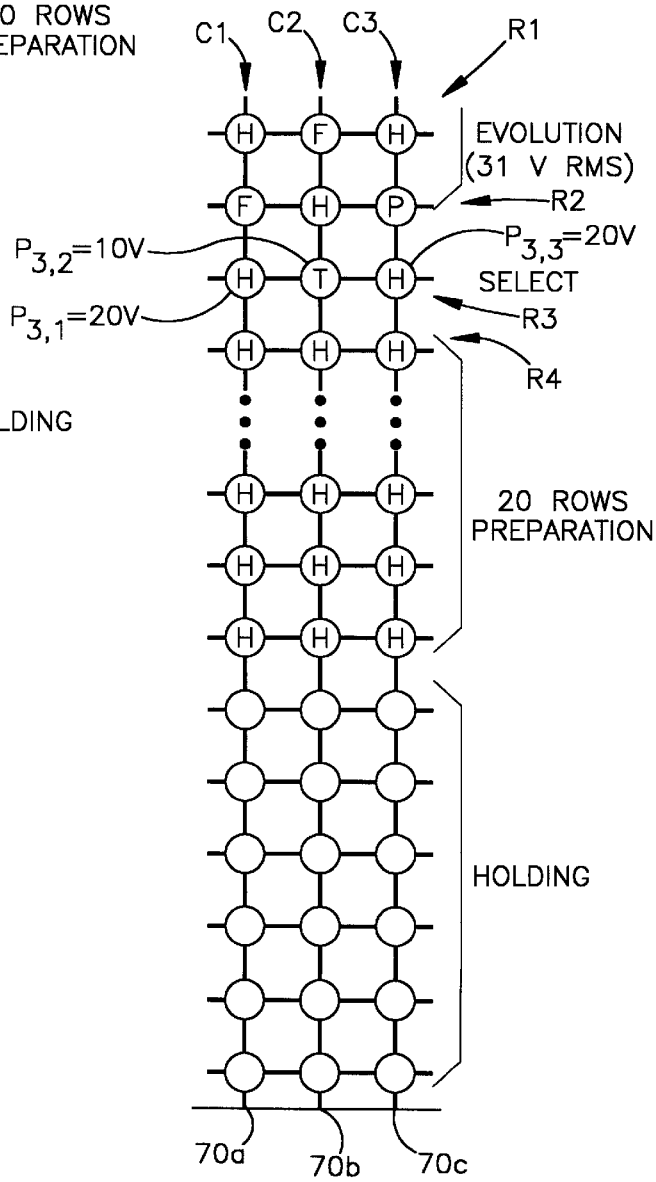
Figure 4E:
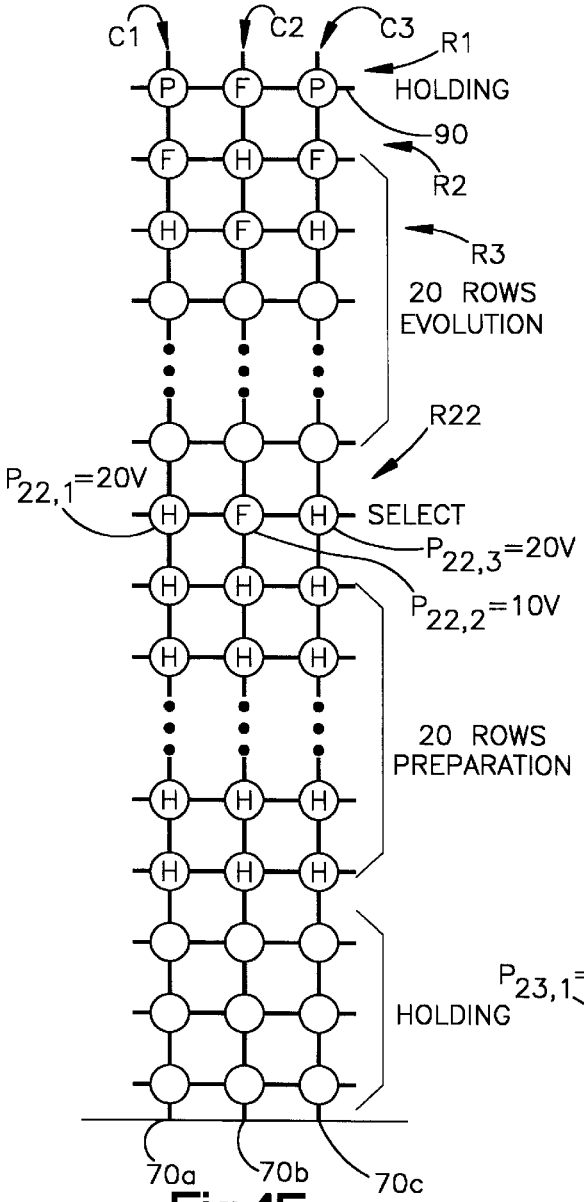
Figure 4F:
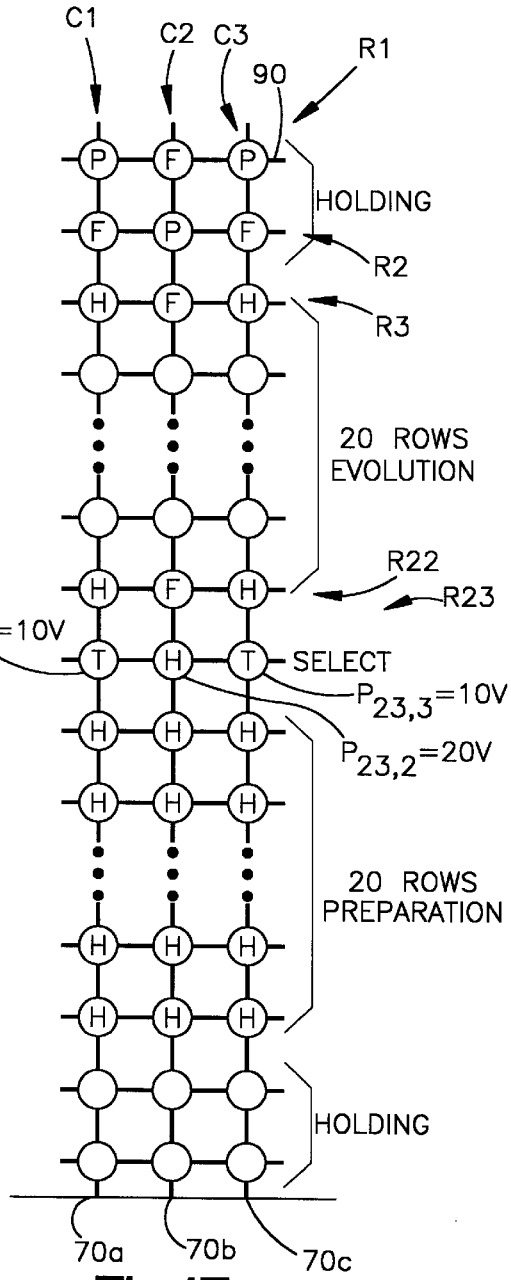

FIGS. 4D–4F shown continued application of control voltages to the electrode array bounding the liquid crystal layer 50 in a pipelining fashion moving down the electrode array.

Waveform Parameters

The waveform parameters for the display 10 and, particularly, the driver circuitry 13 are the following:

Selection: Von(20V), Voff(10V), $\Delta V/2=5V$

Evolution: Ve(31V)

Preparation: Vp(50V)

The maximum voltage output from the integrated circuit is 60 volts.

a) Column Waveforms for Selection Stage

The column waveforms for the twisted planar and the focal conic configurations are shown in FIG. 6B and given by the following equations:

$$Vc1=Vmax=60V$$

$$Vc2=Vmax-Von=40V$$

$$Vc3=Von=20V$$

$$Vc4=0V$$

$$Vc5=Vc1-\Delta V=50V$$

$$Vc6=Vc2+\Delta V=50V$$

$$Vc7=Vc3-\Delta V=10V$$

$$Vc8=\Delta V=10V$$

b) Row Waveforms for Selection Stage

The row voltage waveforms in the selection stage are also shown in FIG. 6B with the resultant voltage waveforms across the pixels. The voltage parameters are:

Vs1=Vc2

Vs2=Vc1

Vs3=Vc4

Vs4=Vc3 c) Row Waveforms for Evolution Stage

The row waveforms for evolution stage is shown in FIG. 6C with the resultant voltage waveforms across the pixels. The waveform parameters are:

$$Ve1=Vc1-(Ve+\Delta V/2)=Vmax-(Ve+\Delta V/2)=24V$$

$$Ve2=Vc2-(Ve-\Delta V/2)=Vmax-Von-(Ve-\Delta V/2)=14V$$

$$Ve3=Vc3+(Ve-\Delta V/2)=Von+(Ve-\Delta V/2)=46V$$

$$Ve4=Vc4+(Ve+\Delta V/2)=(Ve+\Delta V/2)=36V$$

d) Row Waveforms for Preparation Stage

The row waveforms for preparation stage is shown in FIG. 6A with the resultant voltage waveform across the pixels. The RMS amplitude during the preparation is 50=50.9V. The waveform parameters are:

Vp1=0

Vp2=0

Vp3=Vmax

Vp4=Vmax e) Row Wave Forms for Non-active Rows

The row wave forms for Non-active (or holding) rows is shown in FIG. 6D with the resultant voltage wave form across the pixels. The pixels see a constant voltage of $\Delta V/2$ (5V). The wave form parameters are:

$$Vn1=Vc1-\Delta V/2=Vmax-\Delta V/2=55V$$

$$Vn2=Vc2+\Delta V/2=Vmax-Von+\Delta V/2=45V$$

$$Vn3=Vc3-\Delta V/2=Von-\Delta V/2=15V$$

$$Vn4=Vc4+\Delta V/2=\Delta V/2=5V$$

Display Driver Circuitry 13

Figure 11:
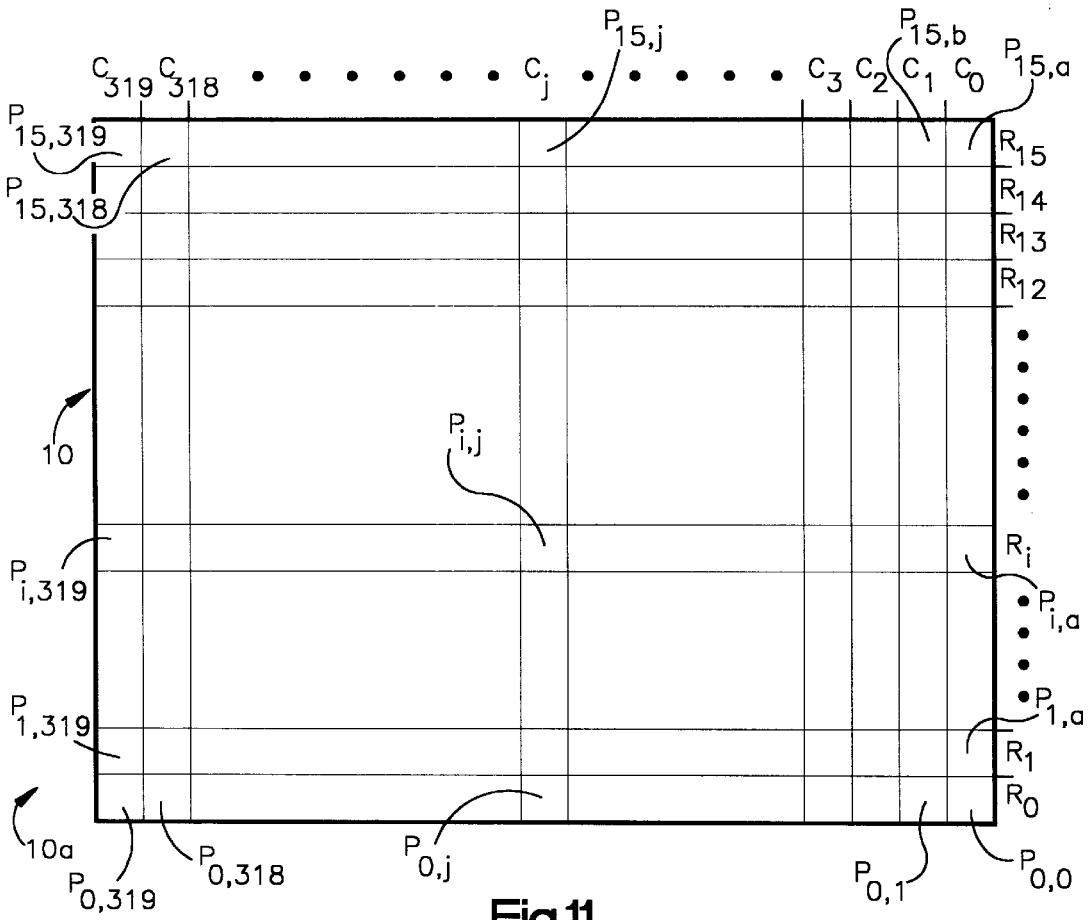
FIG. 11 is a schematic representation of the display.

FIG. 7 is a block diagram of a first embodiment of the display driver circuitry 13 to achieve a specified output from the display 10. The particular display depicted in FIGS. 7 and 11 is a matrix of 320 by 320 picture elements or pixels. This display thus includes 320 rows with each row having 320 individually controllable picture elements.

The display driver circuitry 13 is comprised of row driver circuitry 150 and column driver circuitry 200 mounted on a printed circuit board, a controller 250 and associated circuitry, and a ramp voltage generator 300. Recall that each of the row electrodes R0, R1, R2 . . . , R319 has a contact or connector at the edge of the plate 54 and each of the column electrodes C0, C1, C2 . . . has a contact or connector at the edge of the plate 52 for coupling control voltages to the respective row and column electrodes. The control/logic circuitry of the display driver circuitry 13 is incorporated in the controller (and associated circuitry) 250.

As can be seen in FIG. 7, the row driver circuitry is separated onto two driver boards 150*a*, 150*b* having five row drivers each. The first board 150*a* of row driver circuitry 150 includes five row drivers that drive the even numbered electrode row segments (i.e., R0, R2, R4, . . . , R318), namely, driver1 151*a* (driving segments R0–R62), driver3 151*c* (driving segments R64–R126), . . . , driver9 151*i* (driving segments R256–R318). The second board 150*b* of row driver circuitry 150 includes five row drivers that drive the odd numbered electrode row segments (i.e., R1, R3, R5 . . . R319), namely, driver2 151*b* (driving segments R1–R127), Y, driver10 201*j* (driving segments R257–R319). A suitable row driver is the Model No. HV623 display driver sold by Supertex of Sunnyvale, Calif. The Supertex HV623 display driver is a unipolar driver having an output range of 0–80 volts, 128 voltage levels and 32 output channels per chip. Each of the row drivers have their 32 output channels coupled to a different one of the 320 row electrode segments via suitable edge connections (shown schematically at 152 in FIG. 9 and specifically at 152*a* for the even numbered column drivers 151*a*, 151*c*, . . . , 152*i* and at 152*b* for the odd numbered column drivers 151*c*, 151*d*, . . . , 151*j*). Similarly, the column driver circuitry 200 is mounted on column driver boards 201*a*, 201*b* and is comprised of ten unipolar display drivers (hereinafter column drivers 210*a*, 201*b*, . . . , 201*j*) such as the Supertex Model No. HV623.

As can be seen in FIG. 7, the column driver circuitry is separated onto two driver boards 200*a*, 200*b* having five column drivers each. The first board 200*a* of column driver circuitry 200 includes five column drivers 200*a* that drive the even numbered electrode column segments (i.e. C0, C2, C4, . . . , C318), namely, driver1 201*a* (driving segments C0–C62). driver3 201*c* (driving segments C64–C126), . . . , driver9 201*l* (driving segments C256–C318). The second board 200*b* of column driver circuitry 200 includes five column drivers that drive the odd numbered electrode column segments (i.e. C1, C3, C5, . . . C319), namely, driver2 201*b* (driving segments C1–C63). driver4 201*d* (driving segments C65–C127), . . . , driver10 201*j* (driving segments C257–C319). Each of the column drivers have their 32 output channels coupled to a different one of the 320 column electrode segments 24 via suitable edge connections (shown schematically at 202 in FIG. 9 and specifically at 202*a* for the even numbered column drivers 201*a*, 201*c*, . . . , 201*l* and at 202*b* for the odd numbered drivers 201*b*, 201*d*, . . . , 201*j*).

The row and column driver circuitry 150, 200 is electrically connected to the controller 250 which includes circuitry that controls the presentation of data on the display 10 by controlling the reflectance state of each pixel in the array of pixels that make up the display. The controller 250 also control the presentation on a static display portion 10*b*. Row data, row control logic data, column data and column control logic data from the controller 250 are presented to the row and column driver circuitry 150, 200 on buses 252, 253, 254, 255. The controller 250 also includes five programmable logic devices PLD1 260, PLD2 262, PLD3 264, PLD4 266, PLD5 268, a static random access memory (SRAM) unit 270 and a timer 272. A microprocessor 280 controls operations of the circuitry on the controller 250. The controller 250 receives image data on a bus 282 from a VGA adapter 284. The VGA adapter 284, in turn, receives input on a bus 286 from a personal computer (pc) 288.

Figure 8:
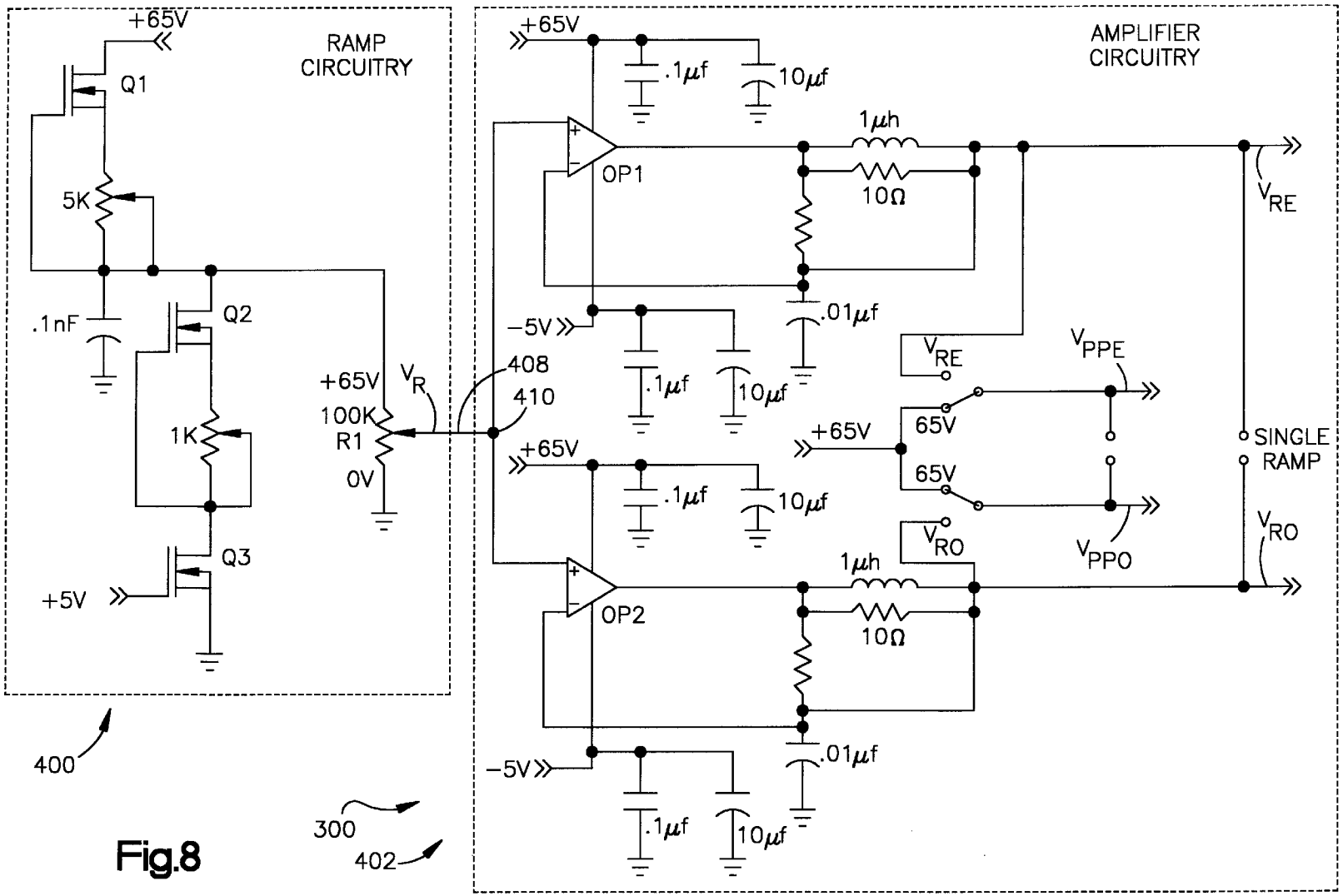
FIG. 8 is a schematic diagram of ramp generation circuitry utilized by unipolar driver circuitry of the present invention.

Coupled to the ramp voltage generator 300 are +5 and +65 volt DC input signals. The generator 300 produces ramped voltage outputs Vre and Vro having a magnitude of 0 to 60 volts at a frequency of f=62.5 kHz. (T=16 microseconds). As can be seen in FIG. 8, the ramp voltage generator 300 includes a ramp circuitry portion 400 and an amplifier circuitry portion 402. The ramp circuitry portion includes n-channel enhancement type MOSFET transistors Q1, Q2, Q3. The +65 volt DC signal is coupled to the drain of transistor Q1, while the +5 volt signal is input to the gate of Q3. The ramp circuitry 400 generates a ramp output voltage Vr having a magnitude range of 0 to 65 volts and a 16 microsecond ramp time at a wiper 408 of a 100 k ohm potentiometer R1. The ramp output voltage Vr 408 is coupled to the amplifier circuitry 402 at a node 410. The ramp output voltage Vr is coupled to the noninverting input terminals of a pair of operational amplifiers OP1, OP2. The +65 volt supply is also coupled to the +V power supply terminal of each operational amplifier OP1, OP2, while a −5 volt supply is coupled to the −V power supply terminal of each operational amplifier. The output of the operational amplifier OP1 is a ramp output voltage Vre which is coupled to the row driver 151*a* and the five odd numbered column drivers 201*a*, 201*c*, . . . , 201*i*. The output of the operational amplifier OP2 at a connector 418 which is coupled to the five odd numbered column drivers 201*b*, 201*d*, . . . , 201*i*. The ramp voltage generator 300 also generates a +65 volt constant magnitude output Vppe which is coupled to the even numbered row drivers 151*a*, 151*c*, . . . , 151*i* and the even numbered column drivers 201*a*, 201*c*, . . . , 201*i*. Another +65 volt constant magnitude output Vppo is coupled to the odd numbered row drivers 151*b*, 151*d*, . . . , 151*l* and the odd numbered column drivers 201*b*, 201*d*, . . . , 201*j*. The row and column driver circuitry 150, 200 generate unipolar voltage waveforms. The unipolar voltage waveforms are synchronized and applied to the row electrode segments and the column electrode segments.

The controller 250 sends a stream of data values to the row driver 151*a* along the bus 252. These data values correspond to desired voltage values to be output by row driver circuitry 150. Recall that the row driver 151*a* provides for 128 voltage level values. Thus, a voltage level value of 127 would cause the driver 151 to "clip" the voltage waveform input by the ramp voltage generator 300 at zero volts and generate a zero volt pulse as an output waveform. On the other hand, a voltage level value of 0 would cause the row driver 151*a* to permit the voltage waveform input by the ramp voltage generator 300 to rise to its maximum +60 volt value and generate a 60 volt pulse having a ramped portion and a constant voltage portion.

Figure 12:
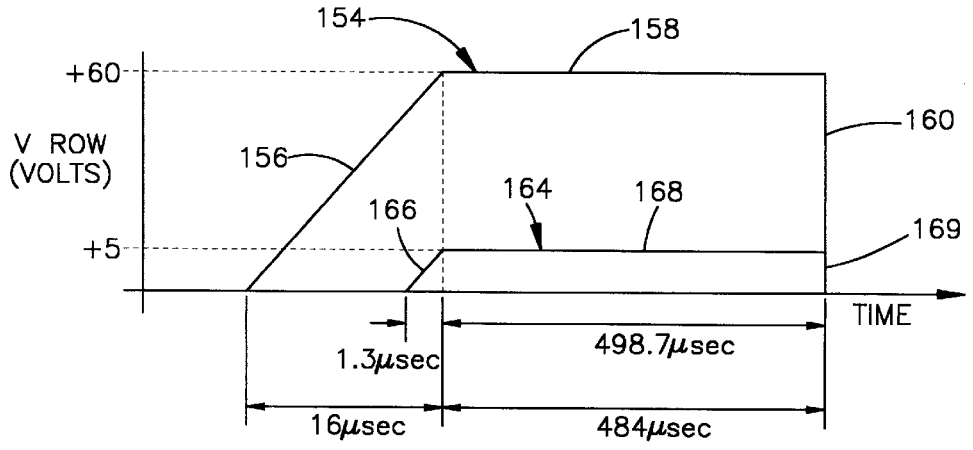
FIG. 12 is a schematic representation of the output of the ramp generation circuitry.
Figure 13:
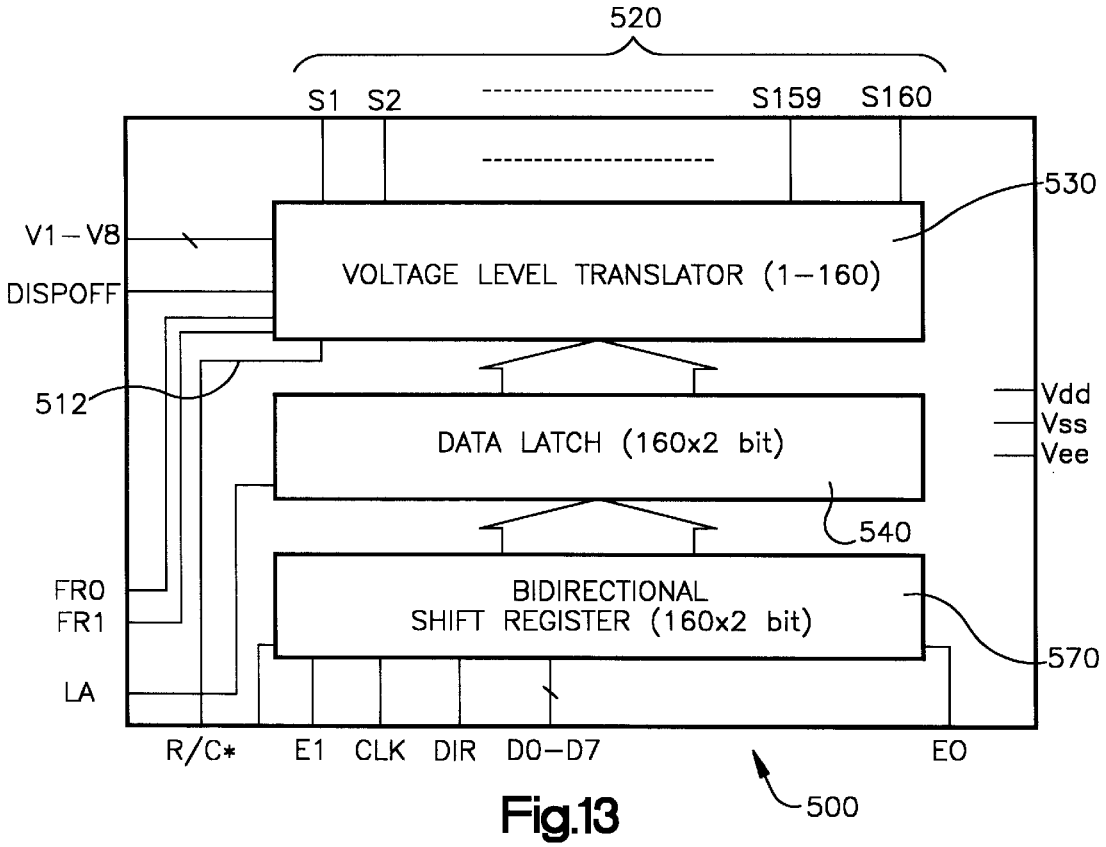
FIG. 13 is a schematic depiction of an integrated circuit for use as either a row electrode or a column electrode energization circuit.

A voltage pulse output of row driver 151*a* is schematically illustrated in FIG. 12 for two different output values, 60 volts and 5 volts. It is required that the row driver and column driver circuitry 150, 200 generate a 60 volt square wave. The controller 250 sends a data value of zero over the bus 252 to the row driver circuitry (say row driver 151*a*, for example). This data value causes a row driver 151 a to allow a voltage waveform generated by the ramp voltage generator 300 to rise to its maximum value of 60 volts. The ramping from zero to 60 volts occurs in 16 microseconds.

The output waveform of the row driver 151*a* is shown at 154 in FIG. 12. The waveform 154 has a ramping up portion 156 which ramps from zero volts to positive 60 volts in 16 microseconds. Next, there is a uniform voltage portion 158 of the waveform 154 having a magnitude of +60 volt and a duration of 484 microseconds (16 microseconds+486 microseconds=500 microseconds=0.5 ms. total waveform duration). Finally, the trailing edge 160 of the waveform drops the waveform voltage back to zero volts. Although the graph of the waveform 154 shown in FIG. 12 is not proportional to more clearly illustrate the ramping portion 156, it should be appreciated that the waveform 154 is substantially a voltage pulse of duration 0.5 ms. The ramping portion 156 accounts for 16/500×100=3.2% of the waveform duration.

FIG. 12 also illustrates a pulse output 164 of row driver 151*a* for 5 volts. The controller sends an appropriate data value over the bus 252 to the row driver circuitry 150. This data value causes the row driver 151*a* to allow a voltage waveform generated by the ramp voltage generator 300 to rise to 5 volts and then clips it off. The ramping from zero to 5 volts occurs in 1.3 microseconds.

The output 164 has a ramping up portion 166 which ramps from zero volts to positive 5 volts in 1.3 microseconds. Next, there is a uniform voltage portion 168 of the waveform 154 having a magnitude of +5 volt and a duration of 498.7 microseconds (1.3 microseconds+498.7 microseconds=500 microseconds=0.5 ms. total waveform duration). Finally, the trailing edge 169 of the waveform drops the waveform voltage back to zero volts. Here, the ramping portion 166 of the waveform 164 accounts for 1.3/500×100=0.26% of the waveform duration.

Figure 9:
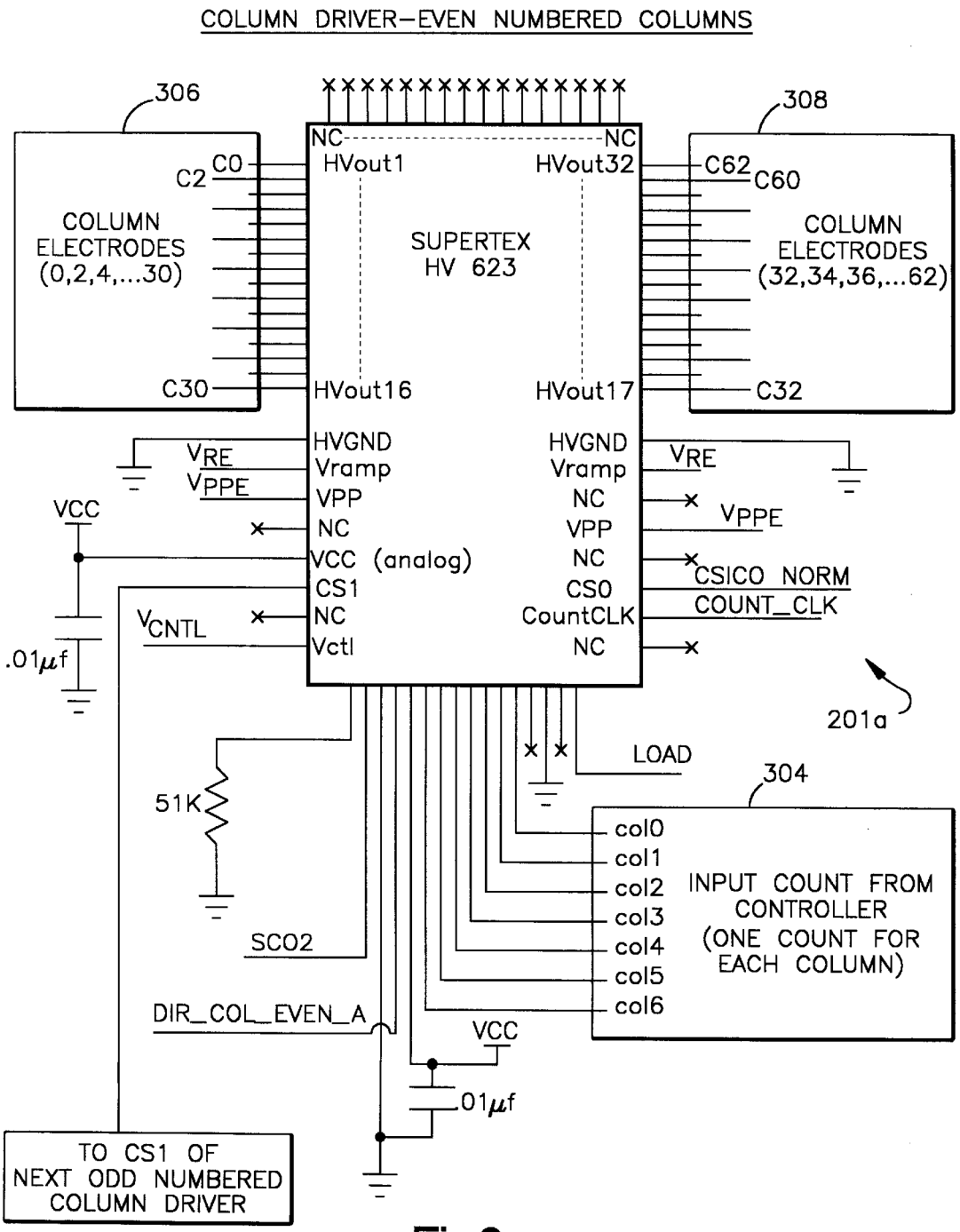
FIG. 9 is a schematic representation of a column driver integrated circuit for energizing even numbered columns of the display.

A schematic representation of a row driver 151*a* for driving a set of even numbered columns is shown in FIG. 9. As can be seen in the box labeled 304, the driver 201 a receives a stream of seven bit binary "counts" from the controller 250 which corresponds to a desired voltage level to be applied to a given even numbered column electrode segment Cj. The voltage level is on a scale of 0 to 127. The boxes labeled 306, 308 show the output of the driver 151*a* being coupled to individual even numbered column electrode segments R0–R62. The output 306, 308 of the driver 201*a* are voltage values, one value for each of the even numbered column electrodes.

Figure 10:
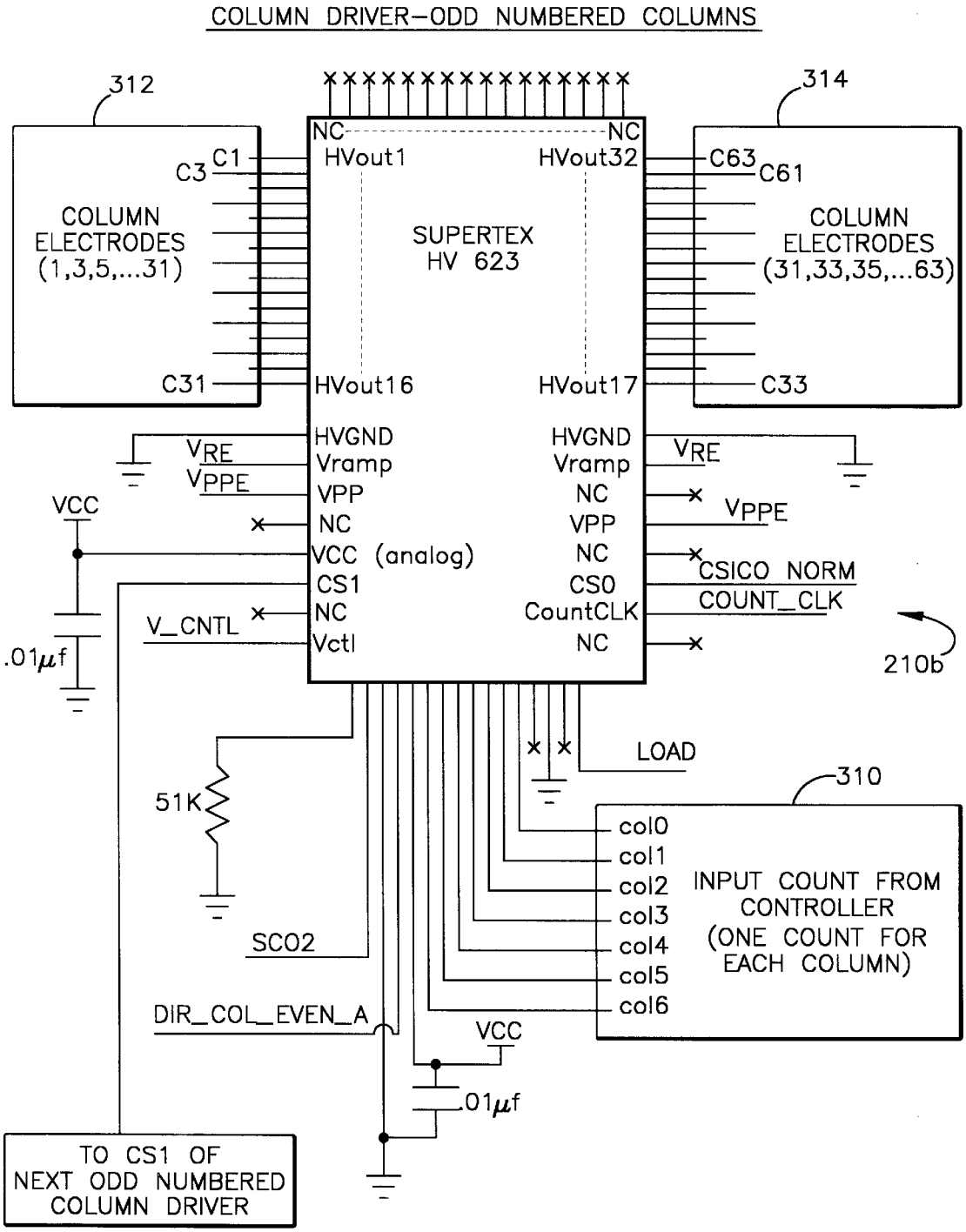
FIG. 10 is a schematic representation of a column driver integrated circuit for driving odd numbered columns of the display.

A schematic representation of a column driver 201*b* driving a set of odd numbered columns is shown in FIG. 10. As can be seen in the box labeled 310, the driver 201*b* receives a stream of seven bit binary "counts" from the controller 250 which corresponds to a desired voltage level to be applied to a given odd numbered column electrode segment Cj. The voltage level is on a scale of 0 to 127. The boxes labeled 312, 314 show the output of the driver 151*b* being coupled to individual odd numbered column electrode segments R1–R63. The output 312, 314 of the driver 201*b* is a succession of voltage level values, one value for each of the even numbered column electrodes.

Simplified Unipolar Implementation

An alternate drive scheme for energizing row and column electrodes is depicted in FIGS. 13–22. This implementation is made possible by assuming Voff=0Volts, Von=12 volts, Vp=37 volts, and Ve=27 volts. This alternative embodiment is characterized by use of eight discrete electrode energization voltages that are depicted in FIG. 14. Preferred values for these eight voltages are V1=0Volts, V2=6volts, V3=10volts, V4=12volts, V5=31 volts, V6=33 volts, V7=37 volts, V8=43 volts. A schematic of a driver circuit 500 (FIG. 13) illustrates one integrated circuit design for implementing the eight level voltage output scheme for use in selectively energizing a liquid crystal display 510. As in the earlier embodiment, the display 510 is made up of a cholesteric liquid crystal material bound by an encapsulating sheet on either side and having row and column electrodes that define picture elements (pixels) whose reflectivity can be individually controlled.

The driver circuit is configured to act as either a row or as a column driver depending on a binary (on/off) input 512 that controls the mode of operation. Regardless of whether a row or a column driver, the circuit 500 has an array of one hundred sixty outputs 520 that are coupled to energization electrodes that form part of the display 510. Each of the one hundred sixty outputs 520 is coupled to a level translator portion 530 of the circuit 500 for converting a digital signal from a latch 540 into a suitable output voltage.

Figure 19:
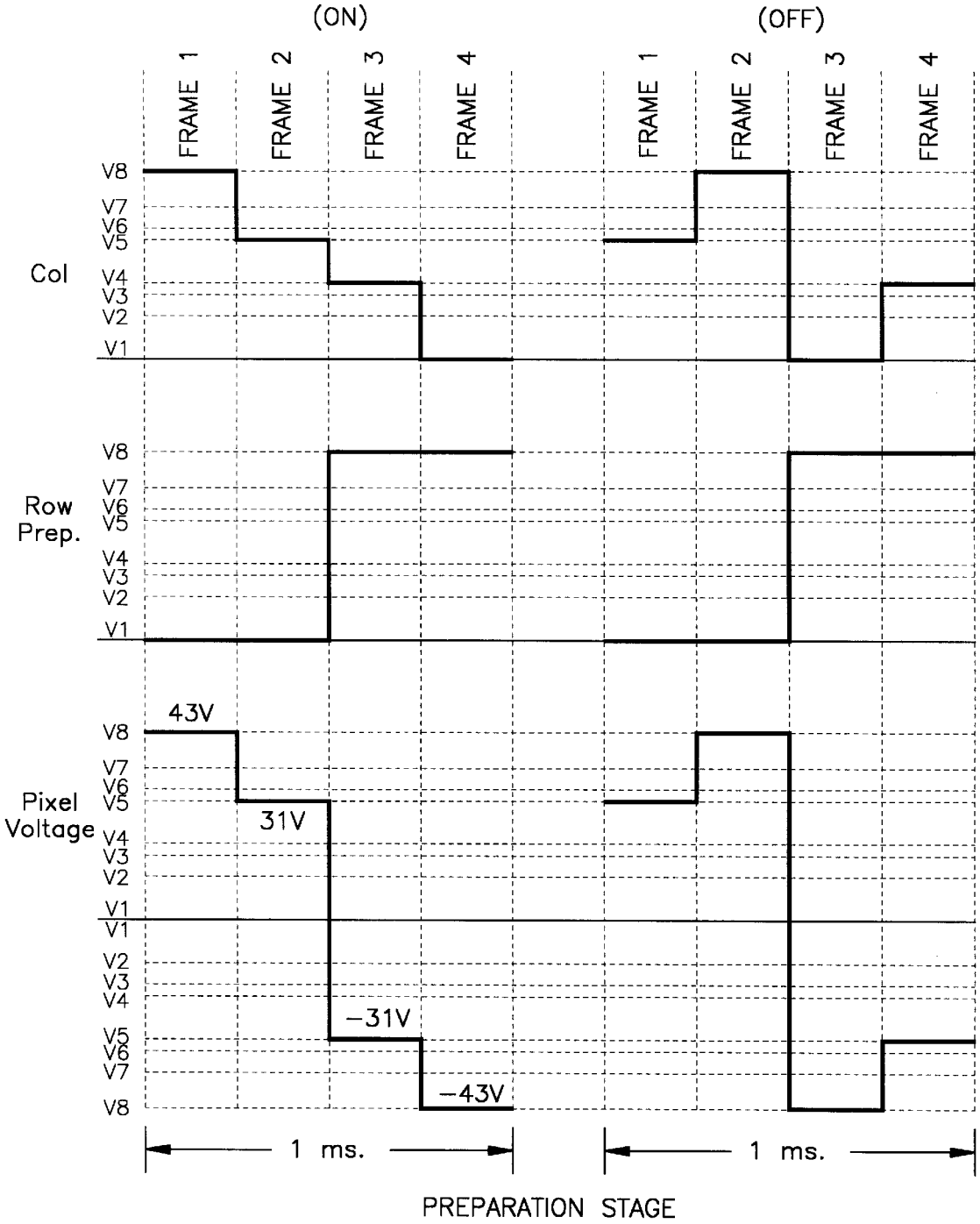
FIG. 19 is a depiction of combinations of row and column driver circuit output voltages to define a preparation phase.

Turning to FIG. 19, one sees on the left a sequence of voltages for four frames (frame 1, frame 2, frame 3, frame 4) output from the row and the column drivers. A topmost depiction in FIG. 19 shows two different column energization waveforms, one for a reflective pixel configuration (on) and a second for a transmissive pixel configuration (off). A second or middle waveform shows the row energization voltage for a particular picture element during a preparation stage. Note, the waveform is the same regardless of whether the column energization is for reflective or absorptive status of the liquid crystal material. When the top and middle waveforms are combined across a region of liquid crystal material, the resultant combined voltages are depicted as the bottommost waveforms in FIG. 19. Each of the bottom waveforms simulates a sinewave having a peak to peak voltage of 43 volts. Note, that the column waveform can be either of the two (right or left) topmost signals in FIG. 19 and still adequately provide a preparation voltage. The voltage applied during the four frames of a preparation phase signal depends on a) whether the driver is a row or column driver b) and if the driver is a column driver whether another pixel in the column undergoing the selection stage has a pixel in an on or in an off (reflective or non-reflective) state.

Figure 20:
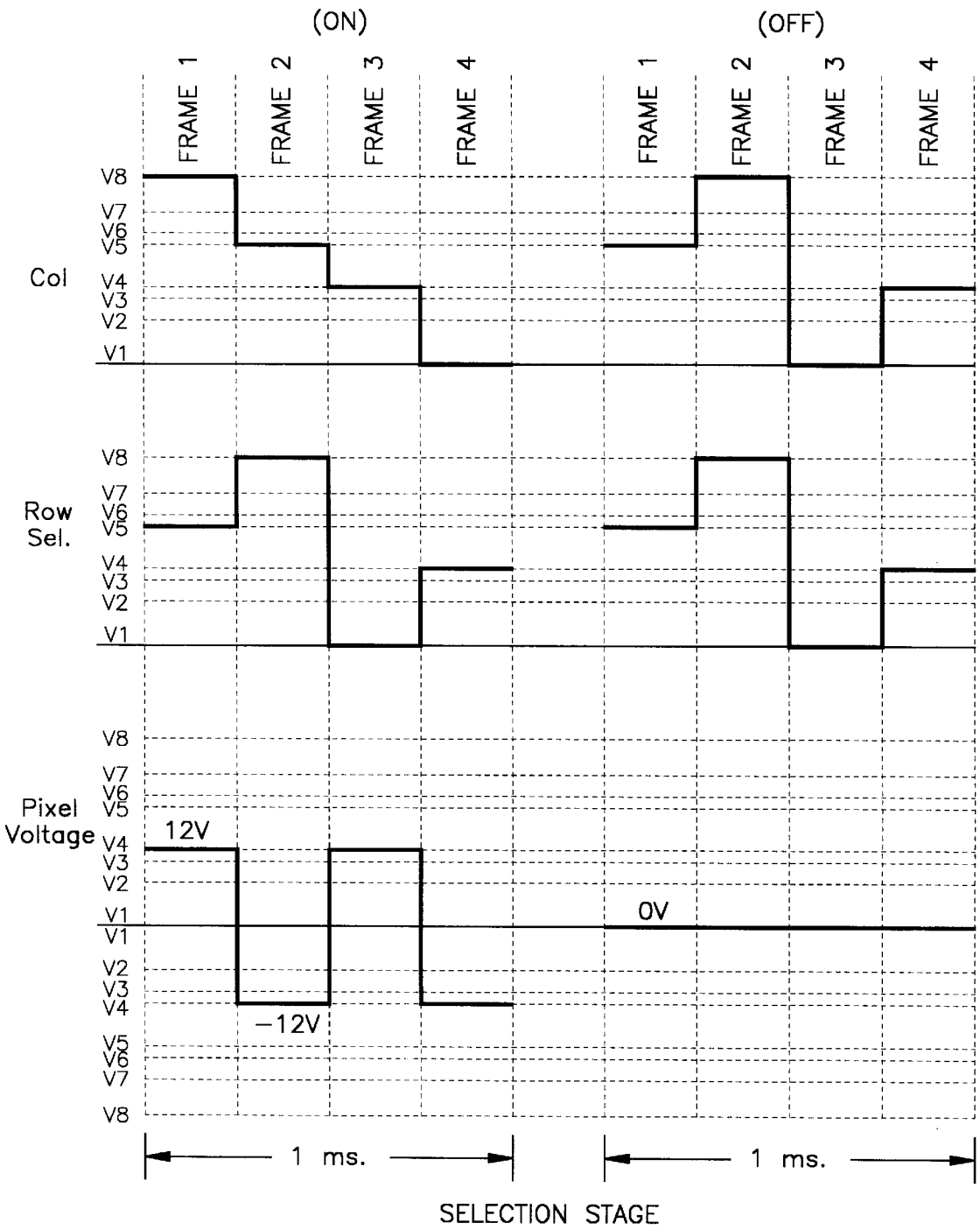
FIGS. 20–22 show row and driver circuit output voltages combining during a selection, an evolution and a holding phase.
Figure 21:
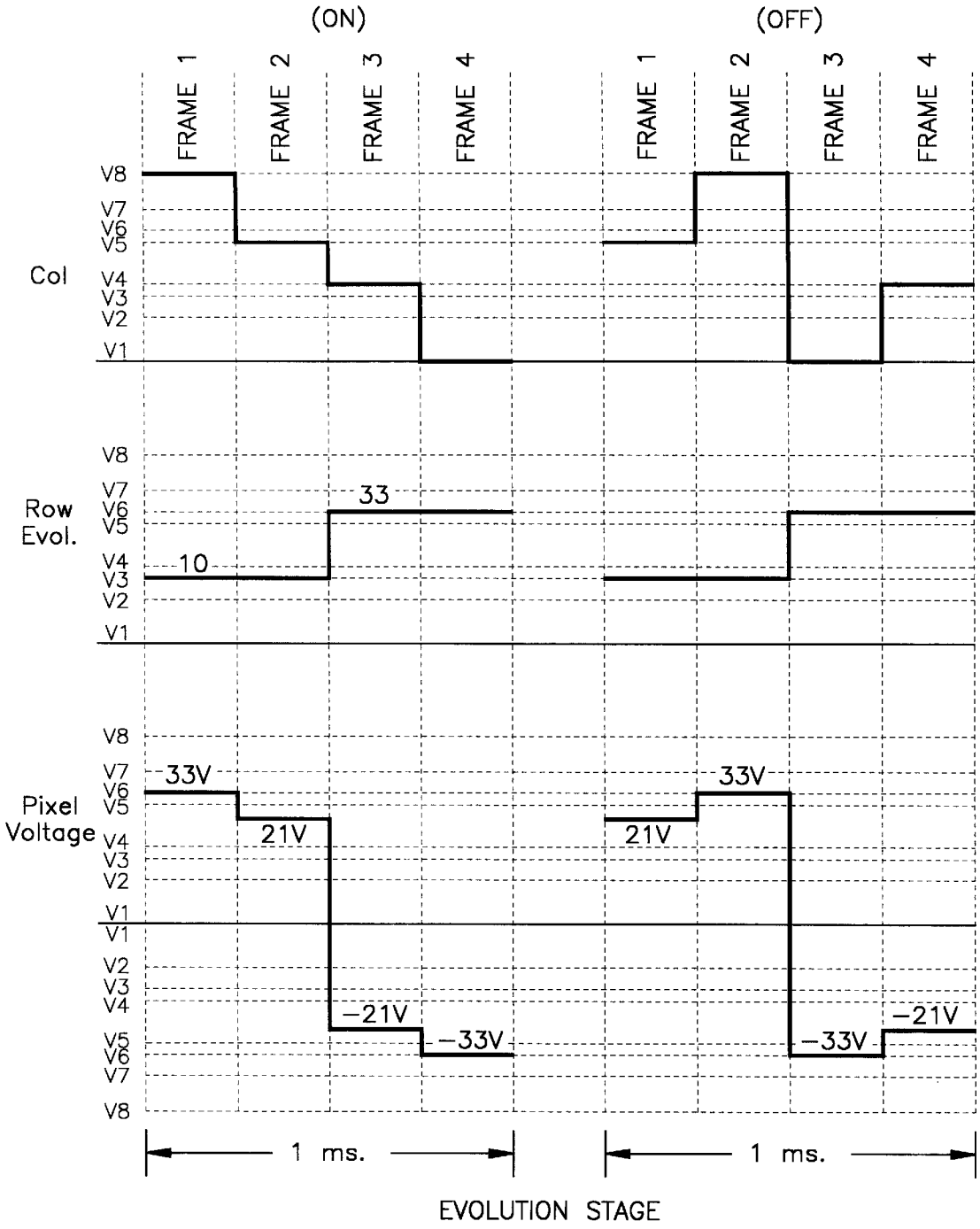
Figure 22:
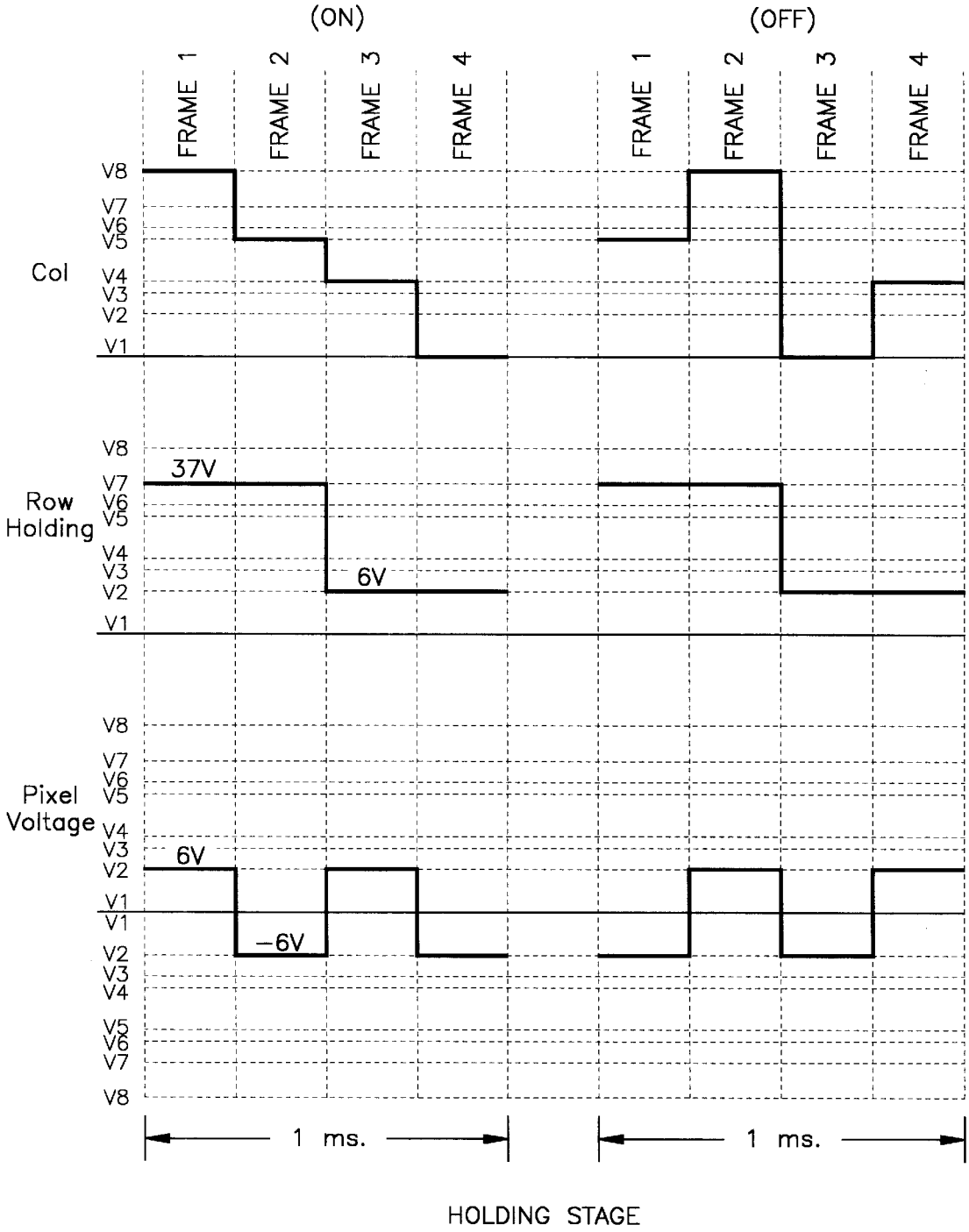

The selection stage, evolution stage, and holding stage voltages for row and column driver circuits are depicted in FIGS. 20, 21, and 22 respectively. The combined voltages are depicted for each of these stages at the bottom of these three figures. Note that the evolution voltage for both right and left depictions in FIG. 21 are sufficient for the evolution stage and that the voltages on the right and left are sufficient for the holding voltages.

Thus, the only effect the different column voltage sequence has is during the selection stage depicted in FIG. 20. In FIG. 20 one sees that the difference between the right and left side signals in FIG. 20 is sufficient to turn the pixel on or off by application of either a 12 volt peak to peak sinusoidal approximation or the application of a zero volt signal.

The voltage waveforms of FIGS. 19–22 are provided by the voltage level translator portion of the circuit 500. This portion of the circuit responds to the frame (FR0, FR1) inputs 560*a*, 560*b* which define the timing of frame1, frame2, etc. Two bits of data from the latch set an appropriate output voltage for a given picture element during the updating of the display.

Figures 17, 18:
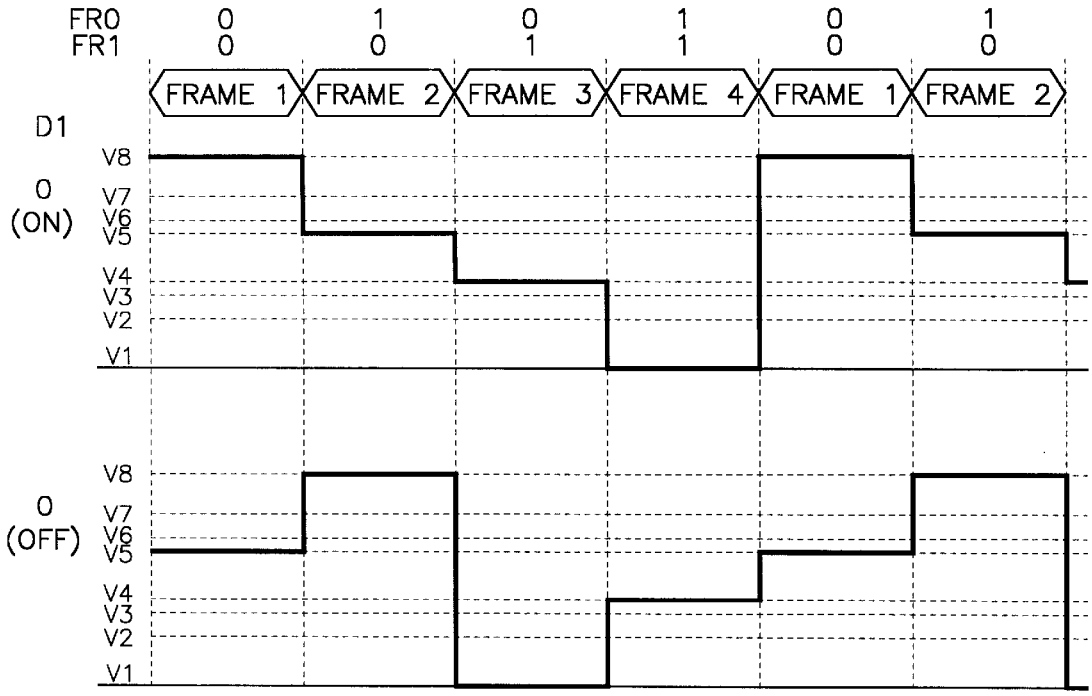
FIG. 18 is a tabulation of the voltage waveforms shown in FIGS. 16 and 17.

Each of the two bit data bits for a given picture element are loaded into a shift register 570 prior to the updating of the display. A truth table for a row driver circuit is shown in FIG. 18. The data bits D1, D0 control the phase and the frame bits FR1, FR0 control the frame within the phase. Each of the 16 possible combinations dictate an output from the driver. The column drivers have the same frame inputs. They require only one data bit, however, that determines when the liquid crystal material for a given region is reflecting or nonreflecting.

A typical display 510 (FIG. 15) has multiple row drivers and multiple column drivers. The display of FIG. 15 includes 4 column drivers and 3 row drivers to provide a display resolution of 640×480 pixels. As seen, an output pin E0 of one driver is coupled to an input pin E1 of a neighboring driver. Use of these input and output pins E0, E1 allow data to be entered into a bi-directional shift register 570 by means of a parallel input 572 to the shift register and then shifted through the multiple shift registers to achieve the pipelined updating of the display discussed above. A clock input CLK to the shift register causes the data to move through the shift register. A direction input DIR to the driver controls the direction of data movement through the shift register. The data is loaded from an external source such as a personal computer (not shown) and then co-ordinated with the CLK input to configure the contents of the multiple shift registers that make up the drivers. Once the data is initialized further clocking of the data will cause the data to shift through the multiple shift registers. After the data has reached an appropriate position in the shift registers, the latch input LA causes the data bits to be transferred into the latch and make them available to the level translator logic that implements the voltage output tables of FIG. 18.

The energization sequences of FIGS. 19–22 are applied for a short duration of about 2 seconds which allows the display of FIG. 15A to updated. The limiting factor is the time needed during the selection stage which is about 1 millisecond. As seen in the energization sequences this amounts to eight different phases and therefore four peaks and valleys of the bi-polar selection voltage waveform.

FIGS. 23, 24, and 24A depict alternative waveform sequences for more rapidly updating a display. FIG. 23 Shows the preparation, selection, evolution and holding stages for a typical pixel configuration to produce a focal conic display state. FIG. 24 shows an energization sequence for producing a twisted planar display state. The selection stage is divided into two subintervals. Use of these subintervals and the pipelined application specific integrated circuit 500 for updating the display 510 allows the update speed to be doubled. While one row is receiving a so called pre-selection signal, the previous row in the update scheme is receiving the selection stage voltage. FIG. 24A shows another selection stage sequence that include a pre-selection, a selection and a post-selection stage. In this embodiment the update rate is three times faster. Experience with these systems suggests breaking the selection stage up into intervals does not degrade the final appearance of the liquid crystal display.

Figure 25A:
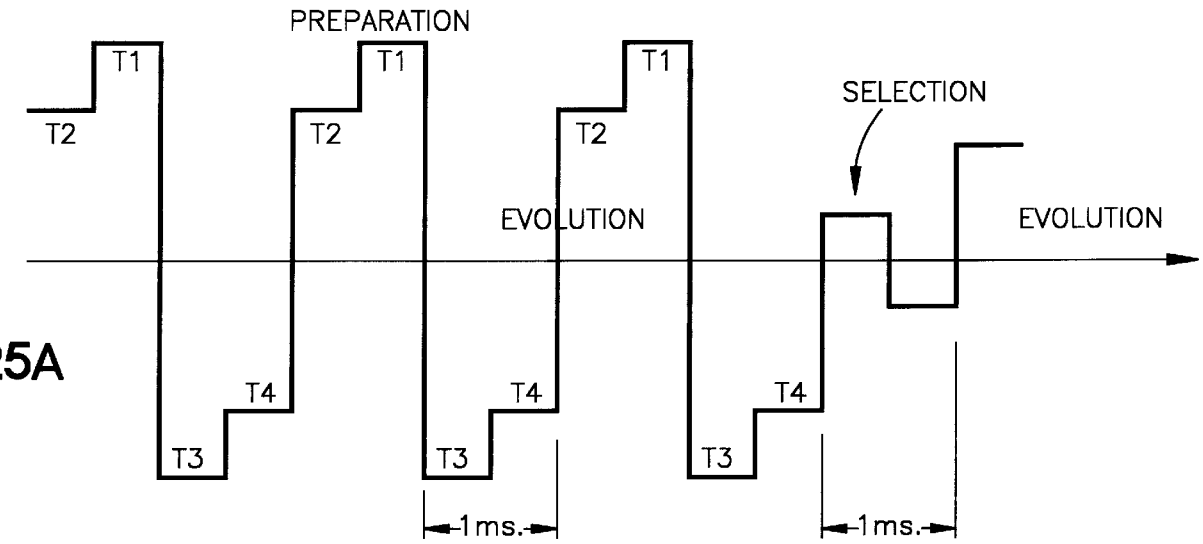
FIGS. 25A and 25B illustrate an alternate drive scheme for activating a liquid crystal display that lowers the drive circuitry switching frequency.
Figure 25B:
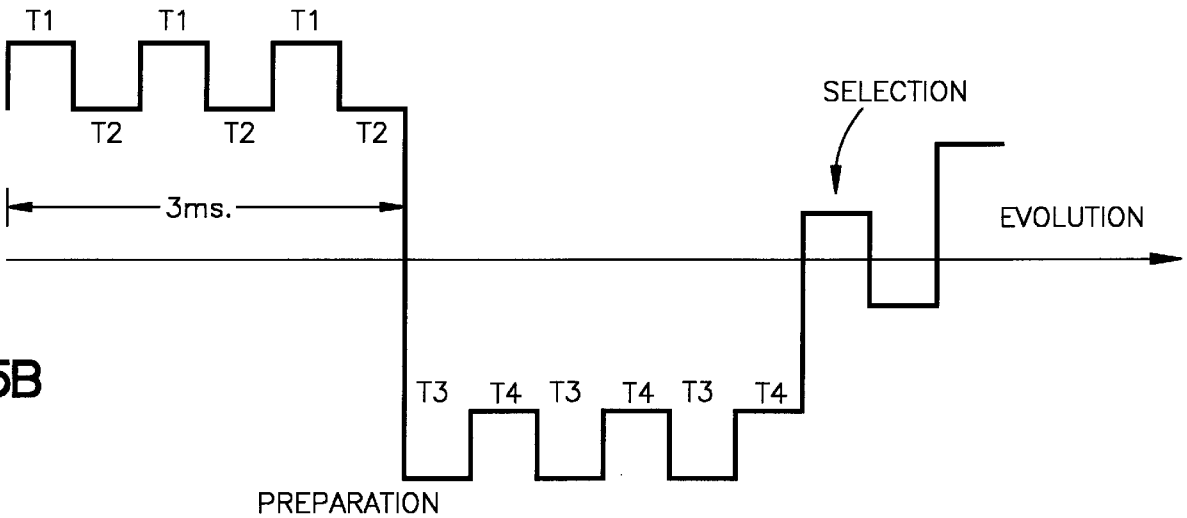

Turning to FIG. 25, by properly combining the frame sequence, such as T1, T2, T1, T2, T1, T2, T3, T4, T3, T4, T3, T4, T3, instead of T2, T1, T3, T4, T2, T1, T3, T4 etc. the frequency of the resultant pixel waveform (the combination of the two unipolar waveforms) can be significantly reduced and in the illustrated process by a factor of three. Such a reduction in switching frequency reduces the power consumption of the display driver electronics. By reducing the power dissipation of the driver circuits, it is possible to extend under battery life during display operation.

Although multiple embodiments of the present invention have been described with a degree of particularity, it is the intent that the invention include all modifications and alterations from the disclosed design falling within the spirit or scope of the appended claims.

I claim:

1. A method of activating a bistable cholesteric liquid crystal material disposed between a first set of electrodes and a second set of electrodes arranged on opposed sides of said liquid crystal material that are adapted to selectively apply an electric field through said liquid crystal material, said method comprising the steps of:

a) energizing said electrodes to establish a preparation voltage across said liquid crystal during a preparation interval, thereafter energizing said electrodes to establish a bipolar selection voltage across said liquid crystal during a selection interval for selecting a final display state for said liquid crystal; thereafter energizing said electrodes to establish an evolution voltage across said liquid crystal during an evolution interval, and thereafter permitting said liquid crystal to exhibit its final display state during a holding interval; and b) said step of energizing during the selection interval accomplished by combining a first unipolar voltage waveform coupled to at least one electrode of the first set of electrodes and a second unipolar voltage waveform coupled to at least one electrode of the second set of electrodes to apply the bipolar selection voltage across the liquid crystal material.

2. The method of claim 1 wherein there are eight or fewer discrete voltage levels that make up the first and second unipolar voltage waveforms applied to electrodes on opposite sides of the liquid crystal material.

3. The method of claim 2 wherein the eight discrete voltage levels are applied by driver circuits coupled to the electrodes that are configured to convert three bits of digital signal data into a chosen one of the eight discrete voltage levels.

4. The method of claim 3 wherein the bistable cholesteric liquid crystal material, the first and second set of electrodes and the driver circuits comprise a liquid crystal display and a driver circuit has outputs coupled to multiple electrodes and includes a memory for storing digital data corresponding to a energization of multiple adjacent picture elements of the display only some of which are being energized with a selection voltage waveform.

5. The method of claim 4 wherein the driver circuit includes a clocking mechanism for shifting the data within the memory to provide an updating of an image displayed by the display.

6. The method of claim 1 wherein at least one of the first and second unipolar voltage waveforms comprises at least two discrete voltage levels.

7. The method of claim 6 wherein the first unipolar voltage waveform comprises at least two discrete voltage levels and second unipolar voltage waveforms comprises at least two discrete voltage levels.

8. The method of claim 7 wherein the step of applying the first and second unipolar voltage waveforms to electrodes on opposite sides of the liquid crystal material produces the bipolar selection voltage by a step of coordinating an application of the at least two discrete voltage levels of the first unipolar waveform with an application of the at least two discrete voltage levels of the second unipolar waveform to produce the bipolar selection voltage.

9. The method of claim 7 wherein the preparation, selection, and evolution voltages all switch polarity due to control of an application of the at least two discrete voltage levels of the first unipolar waveform and an application of the at least two discrete voltage levels of the second unipolar waveform so as to produce bipolar preparation, selection, and evolution voltages.

10. The method of claim 9 wherein at least one of the preparation and the evolution intervals includes application of a bipolar voltage that changes polarity at a frequency less than a frequency of polarity change of the bipolar selection voltage applied during the selection interval.

11. Display apparatus comprising:

a) a layer of bistable cholesteric liquid crystal material;

b) a first set of electrodes and a second set of electrodes spaced on opposite sides of the liquid crystal layer for applying selected energization voltages across multiple picture elements of the liquid crystal layer; and c) control electronics for setting a display state of multiple picture elements of the liquid crystal layer comprising circuitry for:

i) applying a preparation voltage across a selected picture element of the liquid crystal layer during a preparation interval, the selected picture element defined by a region of the layer of liquid crystal material adjacent an overlapping region of one electrode of the first set of electrodes and one electrode of the second set of electrodes during a preparation interval;

ii) applying a bipolar selection voltage across said selected picture element during a selection interval to select a predetermined final display state, the bipolar selection voltage resulting from application of a first unipolar waveform applied to the one electrode of the first set of electrodes and a second unipolar waveform applied to the one electrode of the second set of electrodes; and iii) applying an evolution voltage across said selected picture element during an evolution interval.

12. The display apparatus of claim 11 wherein the control electronics comprises one or more application specific integrated circuits for application of voltages to electrodes of the first set and one or more application specific integrated circuits for application of voltages to electrodes of the second set.

13. The display apparatus of claim 12 wherein the application specific integrated circuit includes a control input for configuring said circuit for applying voltages to a chosen one of the two sets of electrodes.

14. The apparatus of claim 11 wherein the control electronics comprises a driver circuit for applying discrete voltage levels to the electrodes that are configured based upon a digital control signal coupled to the driver circuit.

15. The apparatus of claim 14 wherein the driver circuit applies 8 or fewer discrete voltages levels based upon a three bit control signal applied to said driver circuit.

16. The apparatus of claim 14 wherein the driver circuit has outputs coupled to multiple electrodes and includes a memory for storing digital data corresponding to a energization of multiple adjacent picture elements only some of which are being energized with the selection voltage.

17. The apparatus of claim 16 wherein the driver circuit includes a clocking mechanism for shifting the data within the memory to provide an updating of an image of the display.

18. The apparatus of claim 14 wherein the driver circuit comprises means for applying discrete energization voltages during both a preselection interval and the selection interval.

19. The apparatus of claim 14 wherein during at least one of the preparation and the evolution intervals the driver circuit applies a bipolar voltage that changes polarity at a frequency less than a frequency of polarity change of the bipolar selection waveform applied during the selection interval.

20. The method of claim 11 wherein at least one of the first and second unipolar voltage waveforms comprises at least two discrete voltage levels.

21. The method of claim 20 wherein the first unipolar voltage waveform comprises at least two discrete voltage levels and second unipolar voltage waveforms comprises at least two discrete voltage levels.

22. A method of presenting an image on a display having a bistable cholesteric liquid crystal material disposed between electrodes arranged on opposed sides of said liquid crystal material by applying an electric field through said liquid crystal material, said method comprising the steps of:

a) providing a display having a bistable cholesteric liquid crystal material disposed between electrodes arranged on opposed sides of said liquid crystal material;

b) energizing said electrodes with display driver voltages to i) apply a preparation voltage across said liquid crystal material during a preparation phase, ii) apply a bipolar selection voltage across said liquid crystal material during a selection phase for selecting a final display state for said liquid crystal, iii) applying an evolution voltage across said liquid crystal material during an evolution phase, and iv) permitting said liquid crystal material to exhibit its final display state;

wherein the bipolar selection voltage results from application of a first unipolar waveform applied to one or more electrodes on one side of the liquid crystal material and a second unipolar waveform applied to one or more electrodes on an opposite side the liquid crystal material.

23. The method of claim 22 wherein at least one of the first and second unipolar voltage waveforms comprises at least two discrete voltage levels.

24. The method of claim 23 wherein the first unipolar voltage waveform comprises at least two discrete voltage levels and second unipolar voltage waveforms comprises at least two discrete voltage levels.

25. The method of claim 22 wherein the preparation voltage results from application of a first unipolar waveform applied to one or more electrodes on one side of the liquid crystal material and a second unipolar waveform applied to one or more electrodes on an opposite side the liquid crystal material one electrode of the second set of electrodes.

26. The method of claim 22 wherein the display driver voltages include eight or fewer discrete voltage levels all of the same voltage polarity with respect to a reference potential.

27. The method of claim 26 wherein the electrodes are arranged on opposite sides of the liquid crystal material and wherein an overlapping region of electrodes on opposites sides of the liquid crystal material defines a picture element and further wherein one of said eight distinct voltage levels is applied to each electrode in the overlapping region during the selection phase to discriminate between the final display state of said picture element.

28. The method of claim 26 wherein an electric field direction is periodically reversed through application of different ones of said eight or fewer voltages.

* * * * *